US012593902B2

(12) United States Patent
Samson et al.

(10) Patent No.: US 12,593,902 B2
(45) Date of Patent: Apr. 7, 2026

(54) VERSATILE WALLET

(71) Applicant: Samson Manufacturing Corp., Keene, NH (US)

(72) Inventors: Scott W. Samson, Spofford, NH (US); Ryan Bailey, Wilton, NH (US); Chris Morgan, Spofford, NH (US)

(73) Assignee: Samson Manufacturing Corp., Keene, NH (US)

( * ) Notice: Subject to any disclaimer, the term of this patent is extended or adjusted under 35 U.S.C. 154(b) by 120 days.

(21) Appl. No.: 18/535,182

(22) Filed: Dec. 11, 2023

(65) Prior Publication Data

US 2025/0134225 A1 May 1, 2025

Related U.S. Application Data

(60) Provisional application No. 63/546,059, filed on Oct. 27, 2023.

(51) Int. Cl.
*A45C 1/06* (2006.01)

(52) U.S. Cl.
CPC ..... *A45C 1/06* (2013.01); *A45C 2001/062* (2013.01); *A45C 2001/067* (2013.01)

(58) Field of Classification Search
CPC ..... A45C 1/06; A45C 2001/062; A45C 2001/067; A45C 11/182
USPC ..... 150/137, 147
See application file for complete search history.

(56) References Cited

U.S. PATENT DOCUMENTS

| | | | | |
|---|---|---|---|---|
| 7,334,616 | B2 * | 2/2008 | Kaminski | G09F 3/20 24/3.12 |
| D895,963 | S * | 9/2020 | Anderson | D3/247 |
| D991,346 | S * | 7/2023 | Kane | D3/249 |
| 11,730,242 | B1 * | 8/2023 | Peng | A45C 1/06 150/147 |
| 2014/0060712 | A1 * | 3/2014 | Beckley | A45C 1/06 150/133 |
| 2015/0342314 | A1 * | 12/2015 | Christy | A45C 11/182 206/38 |
| 2017/0065047 | A1 * | 3/2017 | Van Der Laan | B33Y 50/02 |
| 2020/0305564 | A1 * | 10/2020 | Myers | A45C 1/06 |
| 2021/0337945 | A1 * | 11/2021 | Popoff | A45C 13/1069 |
| 2022/0400823 | A1 * | 12/2022 | Clarete | A45C 1/06 |

FOREIGN PATENT DOCUMENTS

| | | | | |
|---|---|---|---|---|
| DE | 202021103375 | U1 * | 6/2021 | A45C 1/06 |

* cited by examiner

*Primary Examiner* — Nathan J Jenness
*Assistant Examiner* — Justin Caudill
(74) *Attorney, Agent, or Firm* — ArentFox Schiff LLP; Laura L. Carroll; Marlo S. Grolnic

(57) ABSTRACT

A versatile wallet includes a metal body formed from a front face plate connected to a rear face plate and forming a cavity therebetween. The front and rear face plates define sidewalls on three separate sides of the body, and an opening on a fourth side of the body. The front face plate and rear face plate include aligned perforations extending around their perimeter. A plurality of rivets extend between aligned perforations in the front face plate and the rear face plate. Each rivet is anchored to the rear face plate by a stud and staked within the perforations of the front face plate. The wallet can include removable side panels allowing for quickly changing the appearance of sidewalls, or for the attachment of functional features.

10 Claims, 30 Drawing Sheets

VERSATILE WALLET

CROSS REFERENCE TO RELATED APPLICATIONS

This application claims priority to and the benefit of U.S. Provisional Patent Application No. 63/546,059, filed on Oct. 27, 2023, and entitled "VERSATILE WALLET", the contents of which are incorporated herein by reference as though fully set forth herein.

FIELD OF THE TECHNOLOGY

The subject disclosure relates to a wallet for storing cash, cards, and other accessories.

BACKGROUND OF THE TECHNOLOGY

Wallets are often used by individuals to carry a number of belongings. Most commonly, those include cash and cards of different types including credit cards, business cards, and licenses. Wallets may also provide other storage capabilities.

A number of challenges present themselves when considering wallet designs, and many different wallet designs are currently available. While design preferences may differ, effective wallet designs should typically, at a minimum, provide an effective means for securing and protecting accessories (particularly for cash and cards) while also allowing for the quick and easy removal of any stored objects. The wallet should be durable enough that there is no risk of material breakdown and failure, which could result in an individual losing their valuables. Size is also an important consideration. Wallets are often stored on an individual's person, typically in a pocket or small bag with limited space, and therefore a compact design is desirable to maximize space and avoid discomfort to a user.

In some instances, wallets may offer additional features and utility to individuals. For example, a wallet may include a means for easily attaching other equipment, such as electronic equipment like an RFID (radio-frequency identification) tag, Apple AirTag, or other piece of equipment. The wallet can also have a body shaped to provide additional, mechanical utility.

Further, since a wallet is an accessory, it is important to combine these utilitarian considerations with a design that is attractive.

SUMMARY OF THE TECHNOLOGY

In light of the needs described above, in at least one aspect, the wallet disclosed herein provides a durable, compact, and versatile wallet that allows a user to safely secure their belongings, including cash and cards. The wallet disclosed herein is versatile in that it provides a number of inherent features and provides a structure that allows additional features to be easy added or removed as desired.

BRIEF DESCRIPTION OF THE DRAWINGS

So that those having ordinary skill in the art to which the disclosed system pertains will more readily understand how to make and use the same, reference may be had to the following drawings.

DETAILED DESCRIPTION

Figure 1:
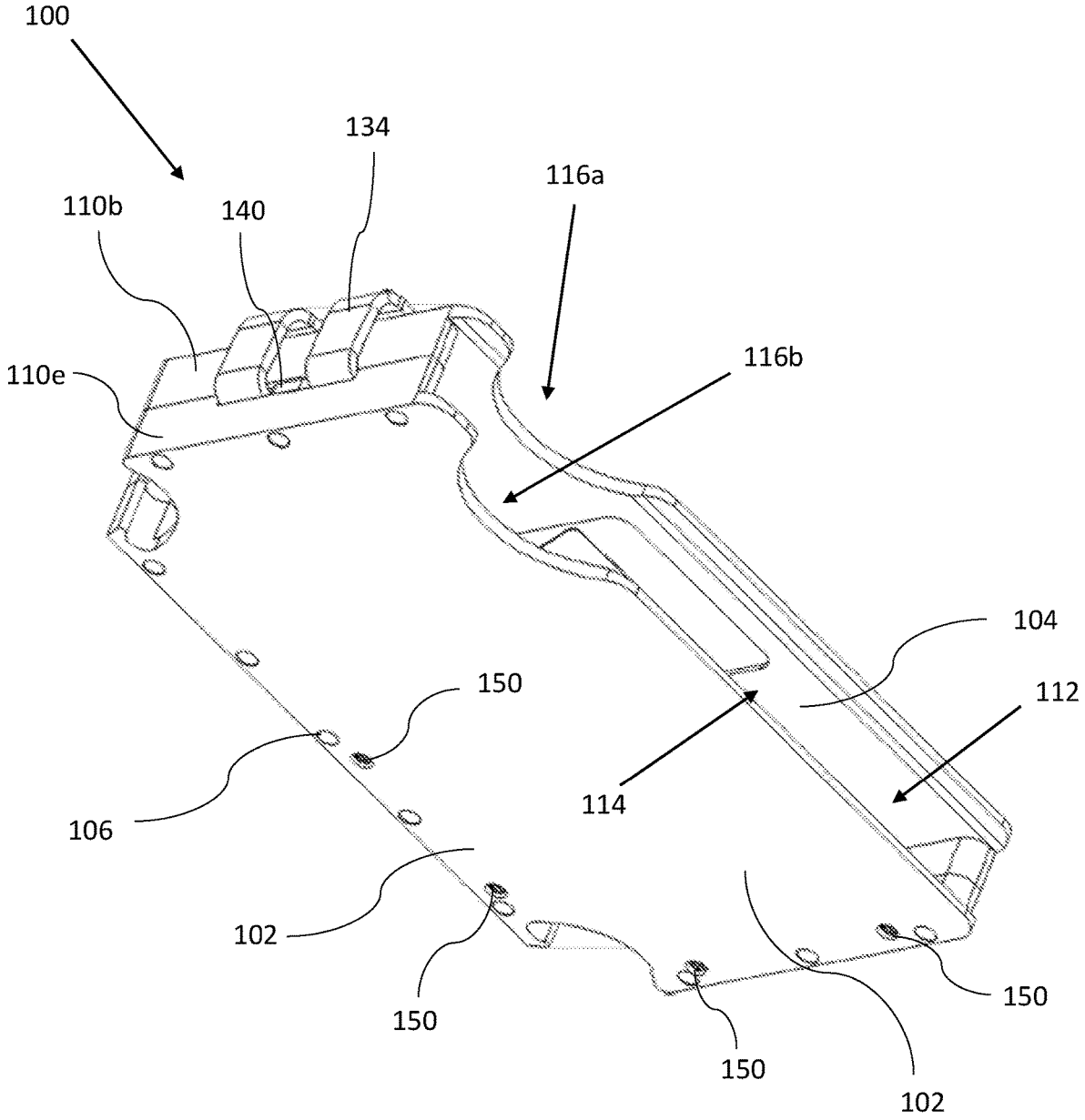
FIG. 1 is a front perspective view of a first embodiment of a wallet.
Figure 2:
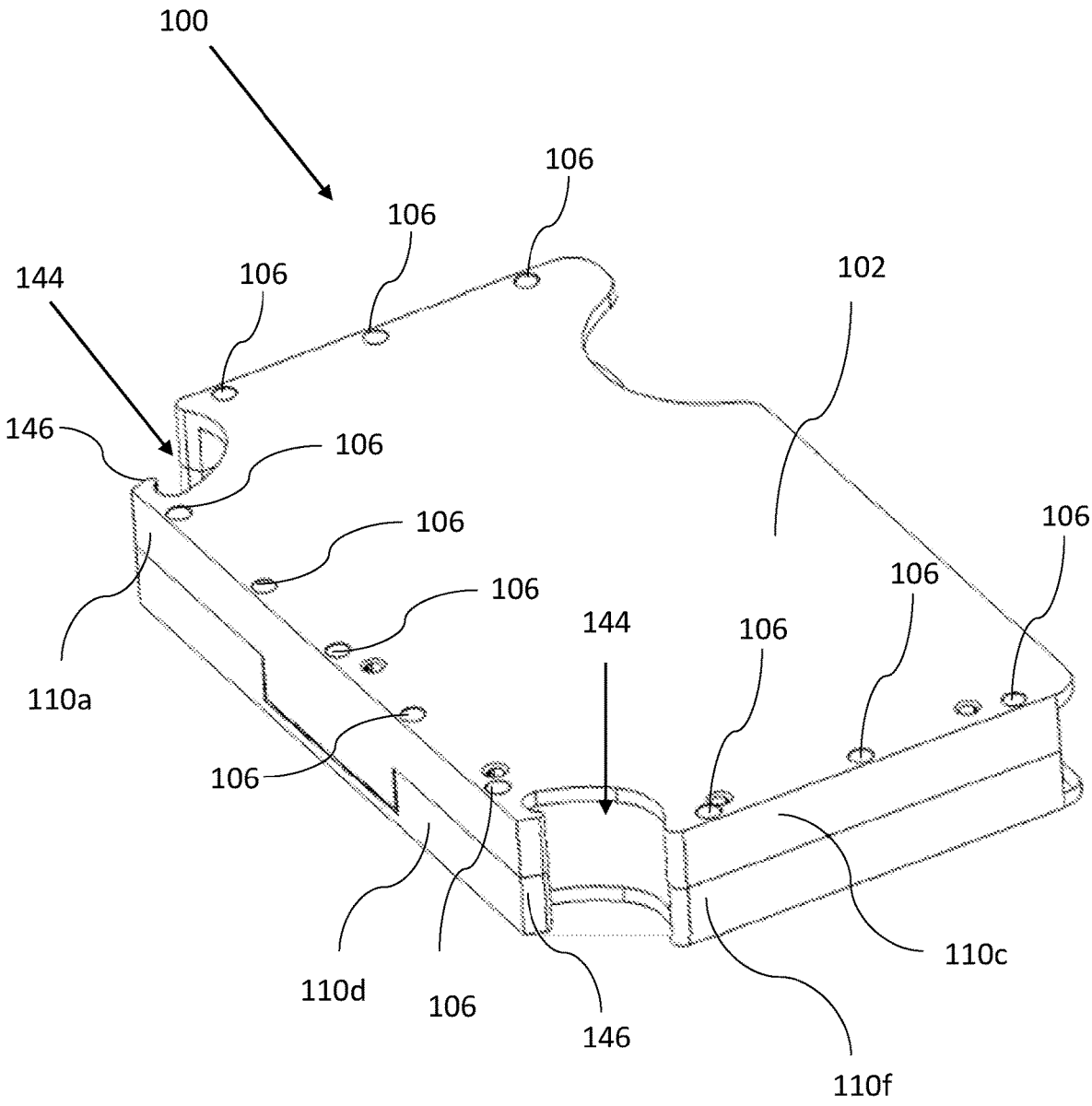
FIG. 2 is a front perspective view of the wallet of FIG. 1.
Figure 3:
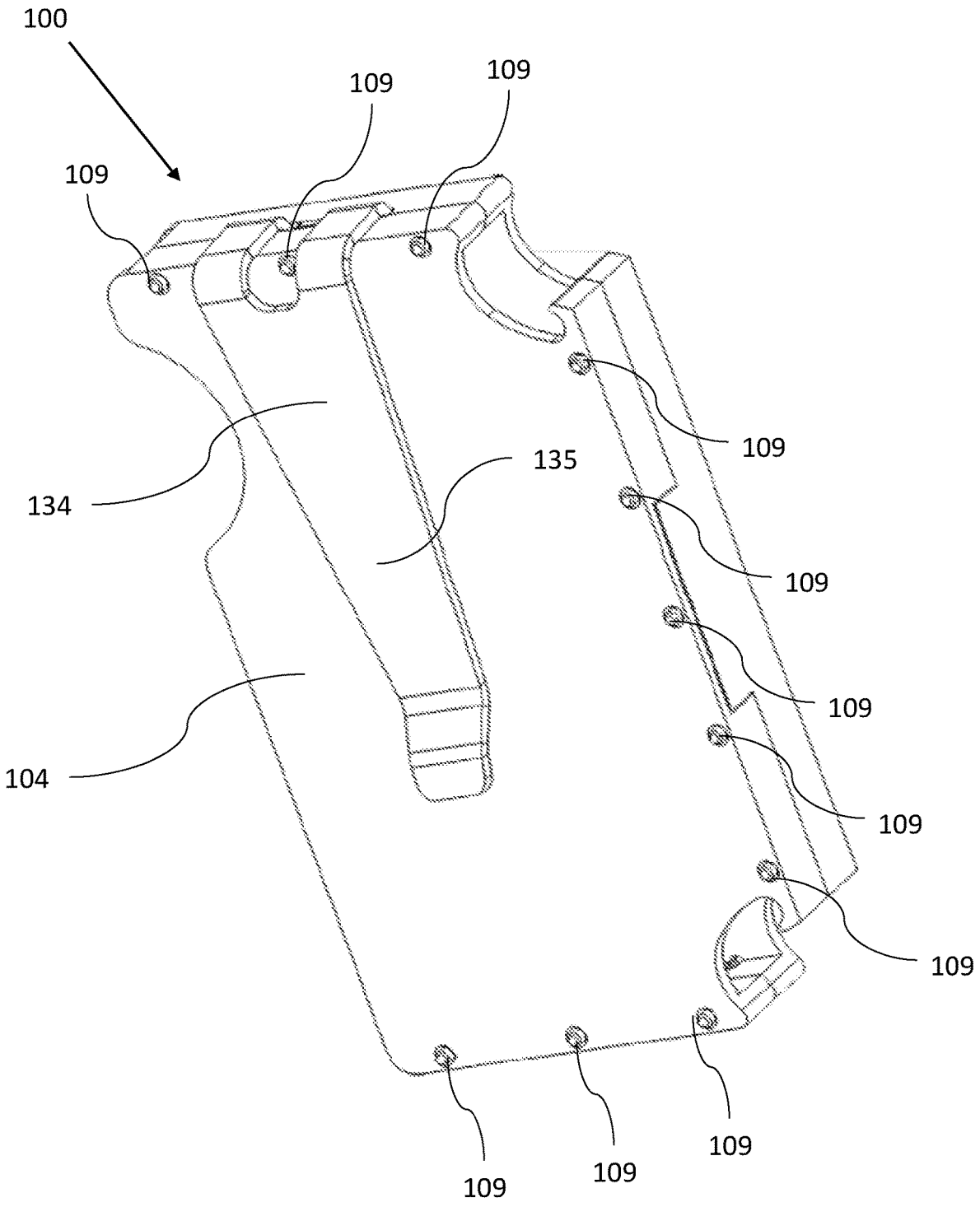
FIG. 3 is a rear perspective view of the wallet of FIG. 1.
Figure 4:
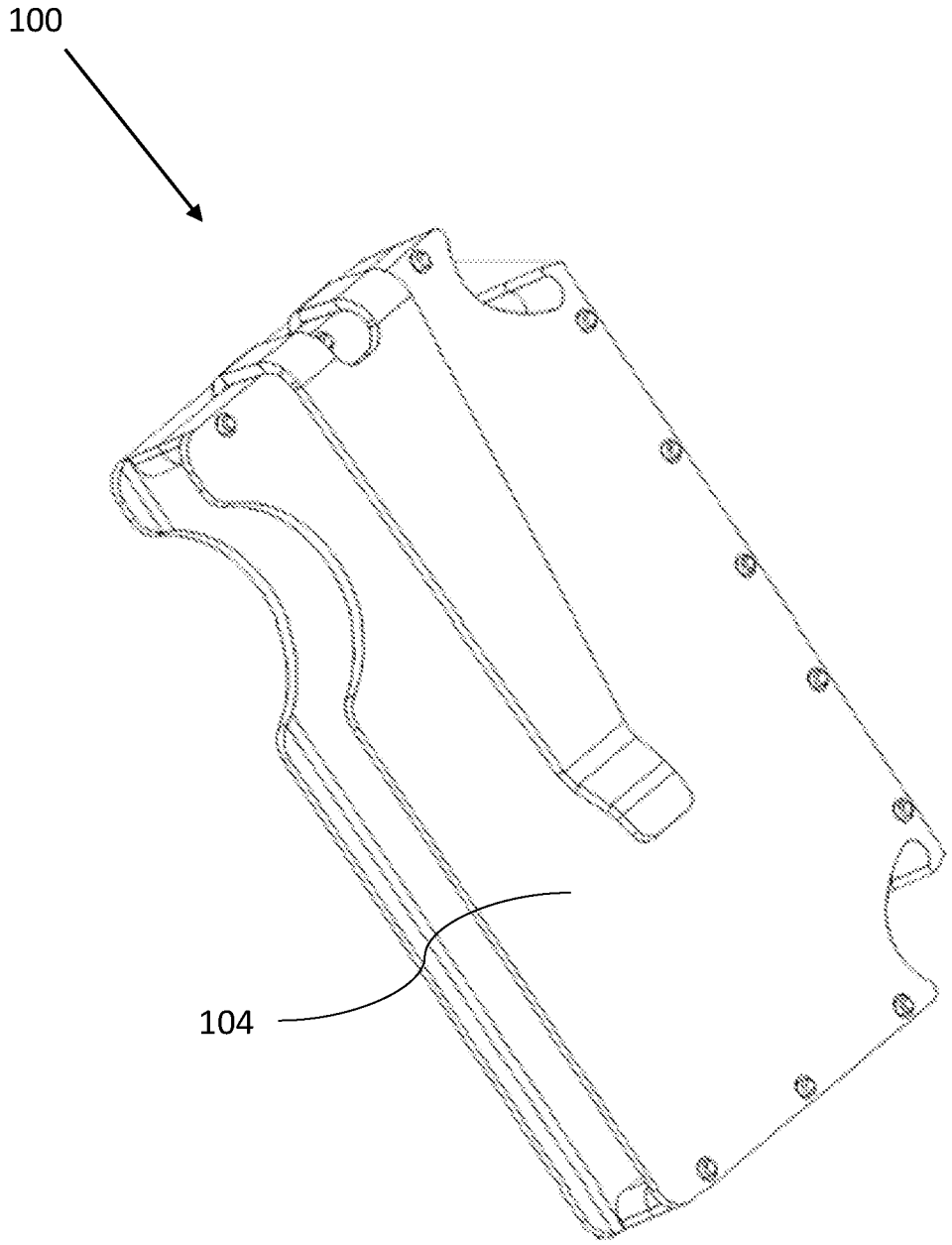
FIG. 4 is a rear perspective view of the wallet of FIG. 1.
Figure 5:
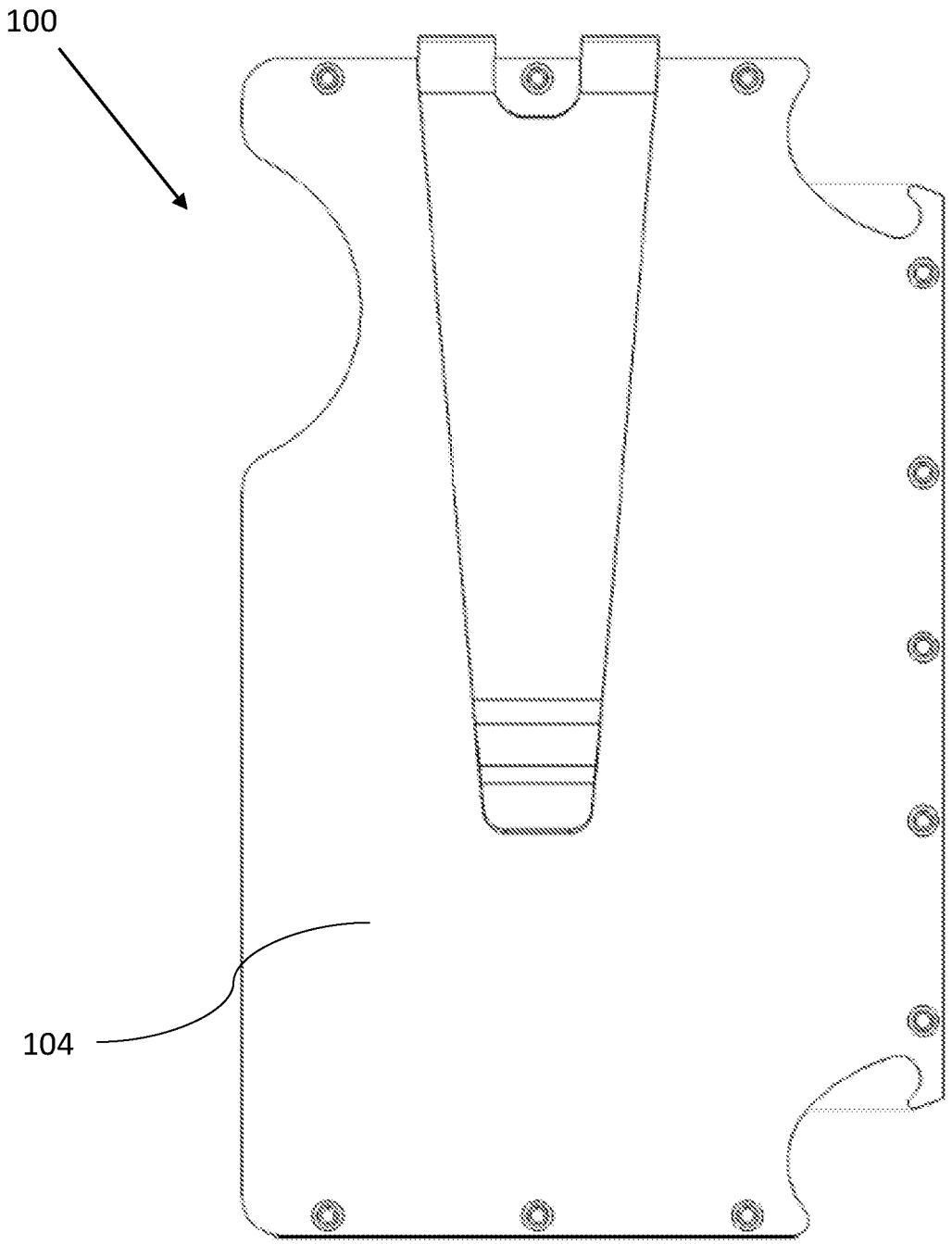
FIG. 5 is a rear view of the wallet of FIG. 1.
Figure 6:
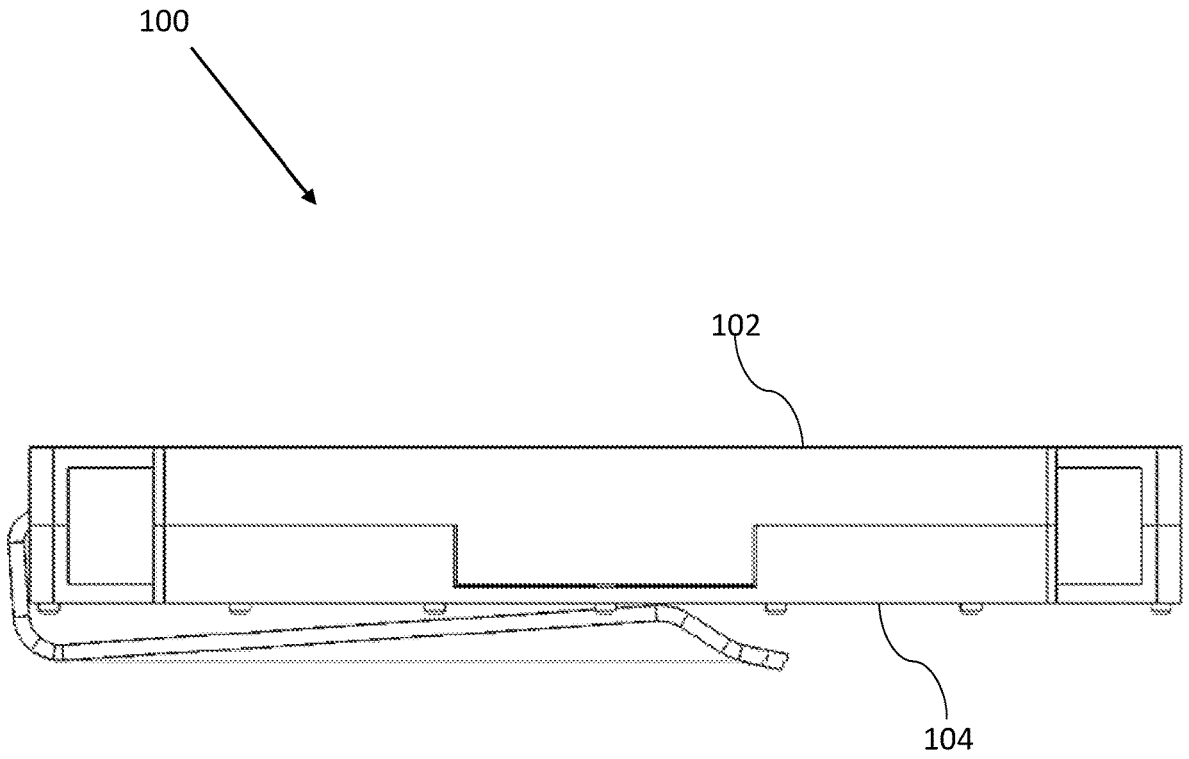
FIG. 6 is a left side view of the wallet of FIG. 1.
Figure 7:
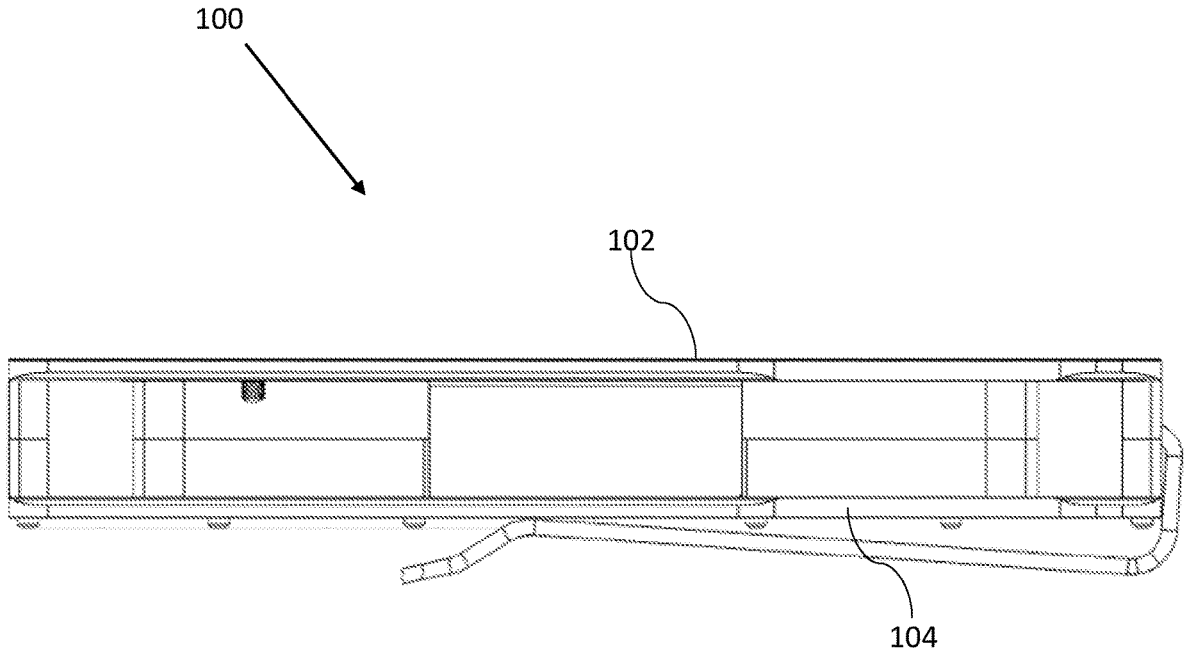
FIG. 7 is a right side view of the wallet of FIG. 1.
Figure 8:
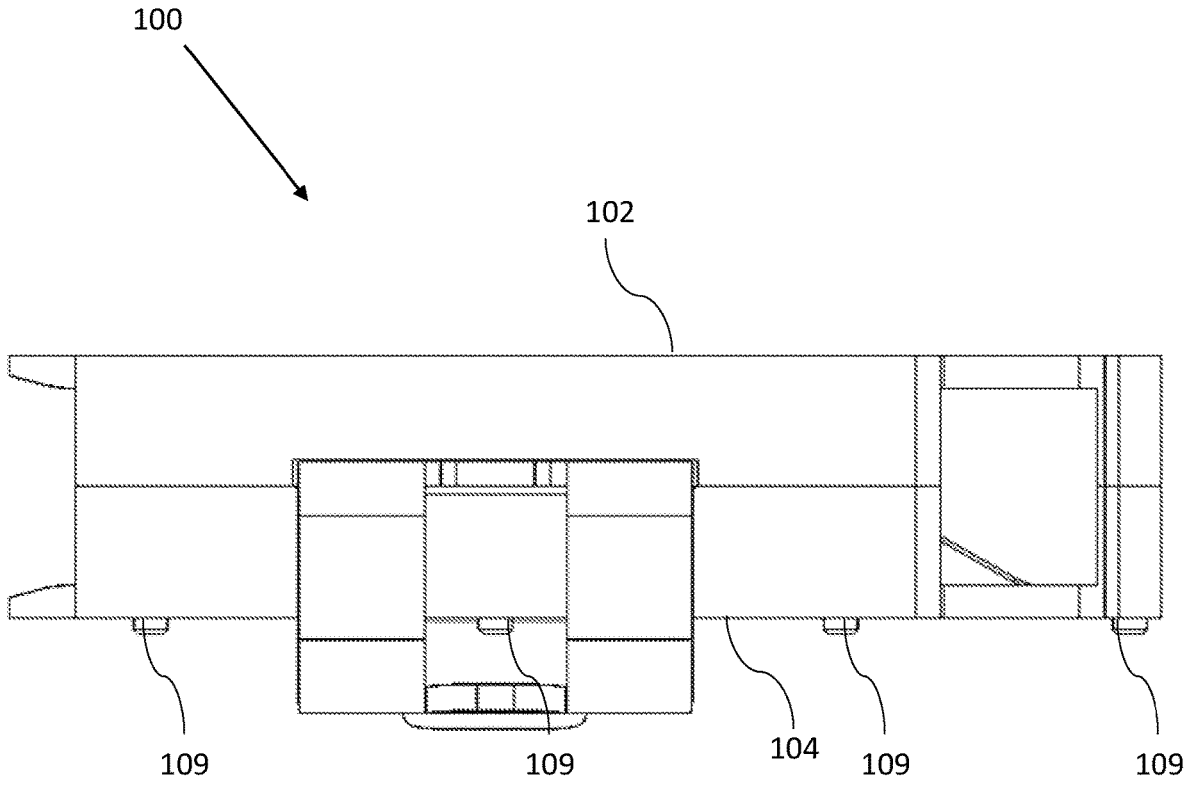
FIG. 8 is a top view of the wallet of FIG. 1.
Figure 9:
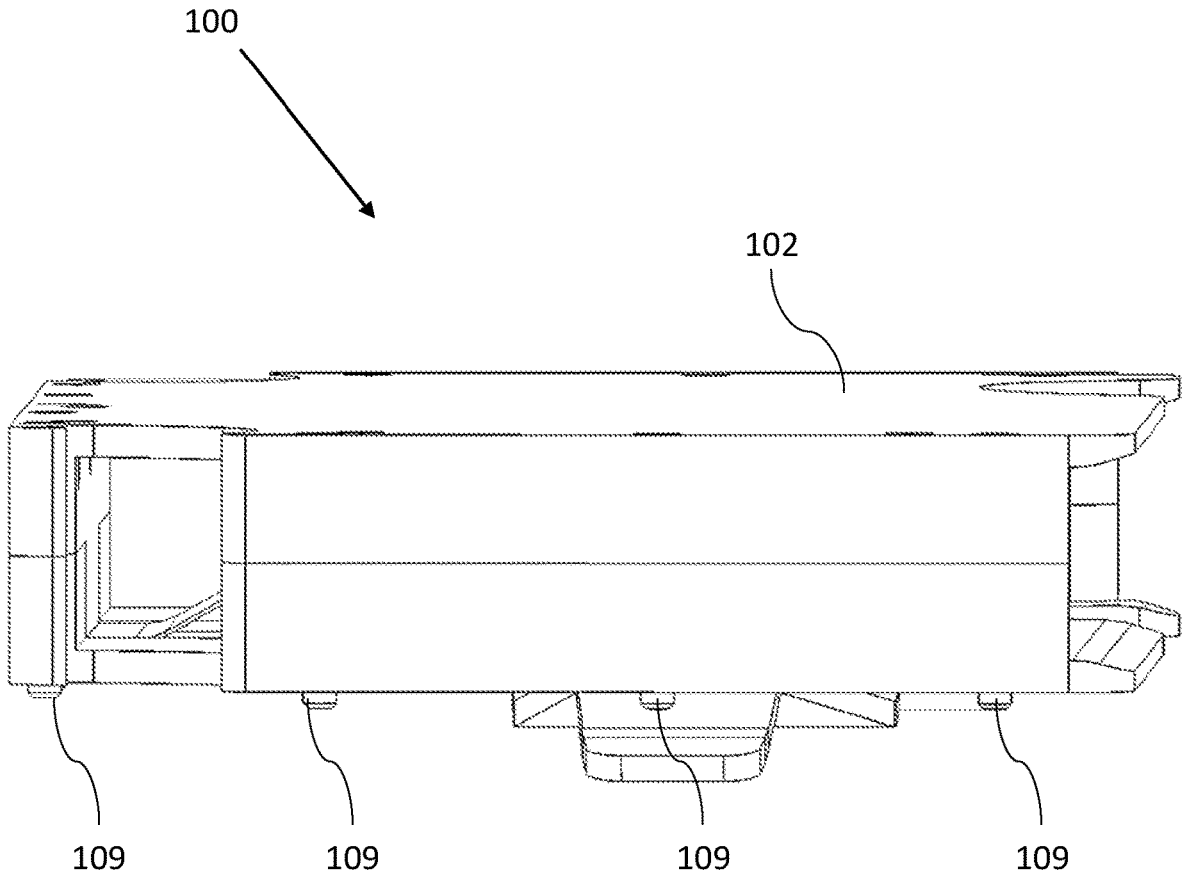
FIG. 9 is a bottom view of the wallet of FIG. 1.

The subject technology overcomes many of the prior art problems associated with wallets. In brief summary, the subject technology provides a durable and versatile wallet which includes a number of inherent features and also allows a user to selectively add or remove other features. The advantages, and other features of the wallet disclosed herein, will become more readily apparent to those having ordinary skill in the art from the following detailed description of certain preferred embodiments taken in conjunction with the drawings which set forth representative embodiments of the present invention. Like reference numerals are used herein to denote like parts. Further, words denoting orientation such as "upper", "lower", "distal", and "proximate" are merely used to help describe the location of components with respect to one another. For example, an "upper" surface of a part is merely meant to describe a surface that is separate from the "lower" surface of that same part. No words denoting orientation are used to describe an absolute orientation (i.e., where an "upper" part must always at a higher elevation).

Figure 10:
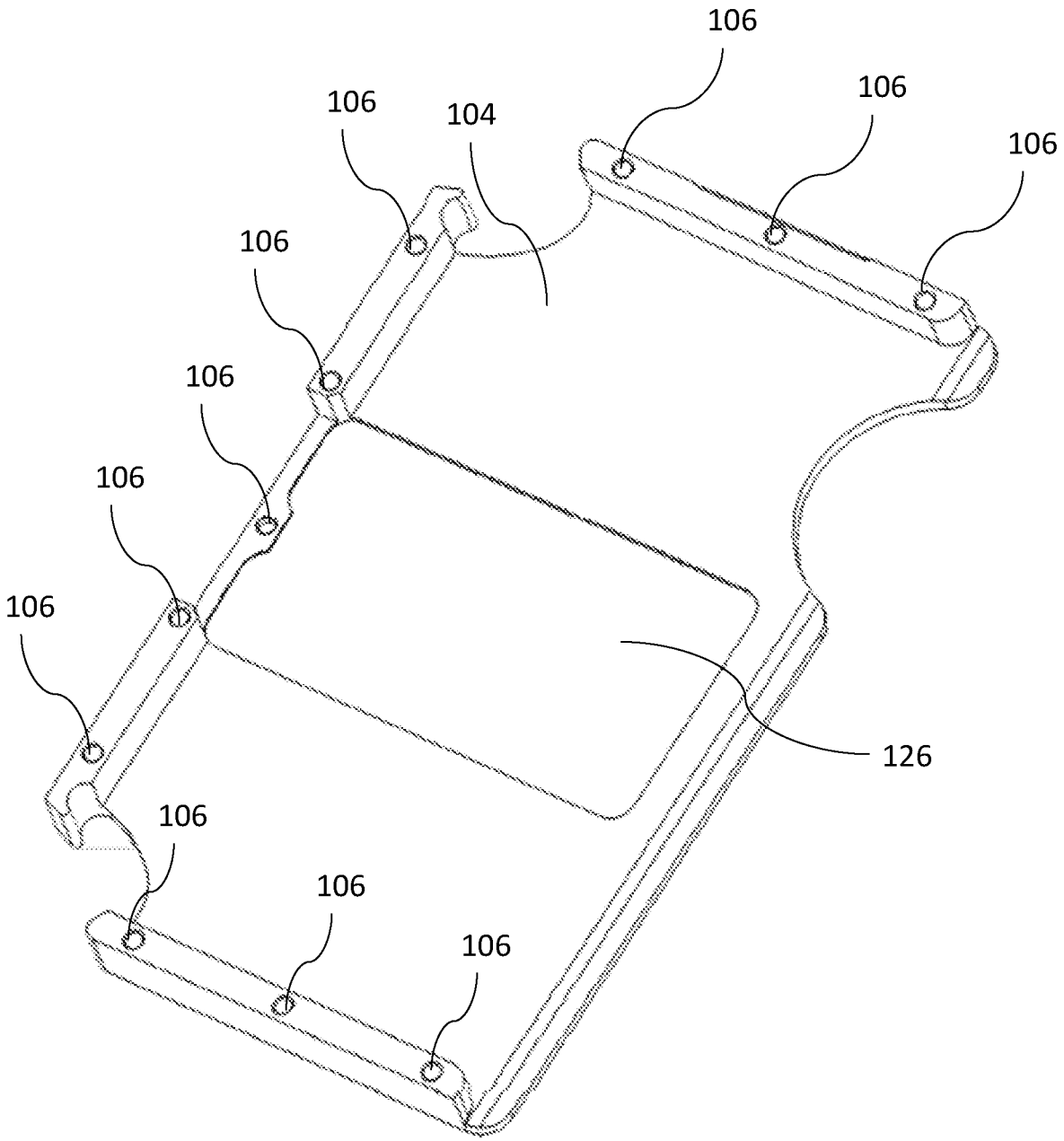
FIG. 10 is an interior view a rear face plate of the wallet of FIG. 1.
Figure 11:
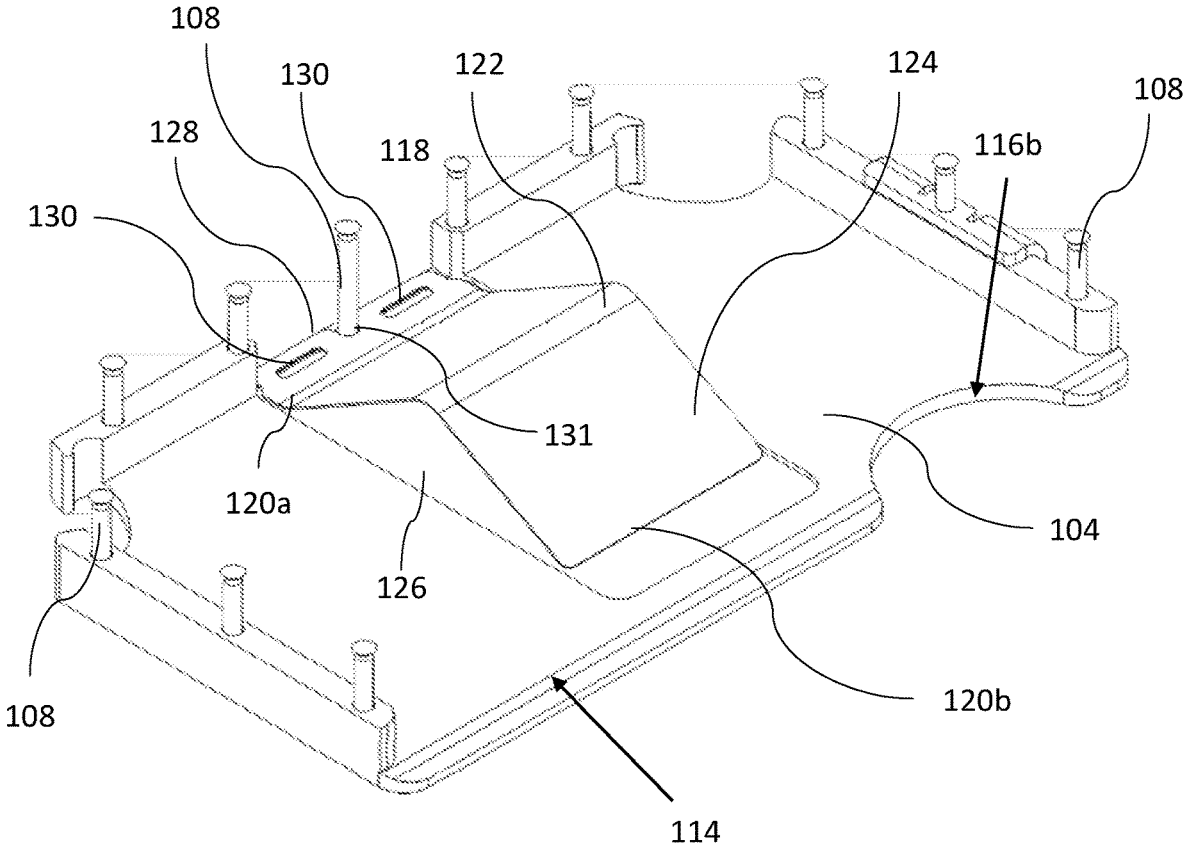
FIG. 11 is an interior view a rear face plate and spring of the wallet of FIG. 1.
Figure 12:
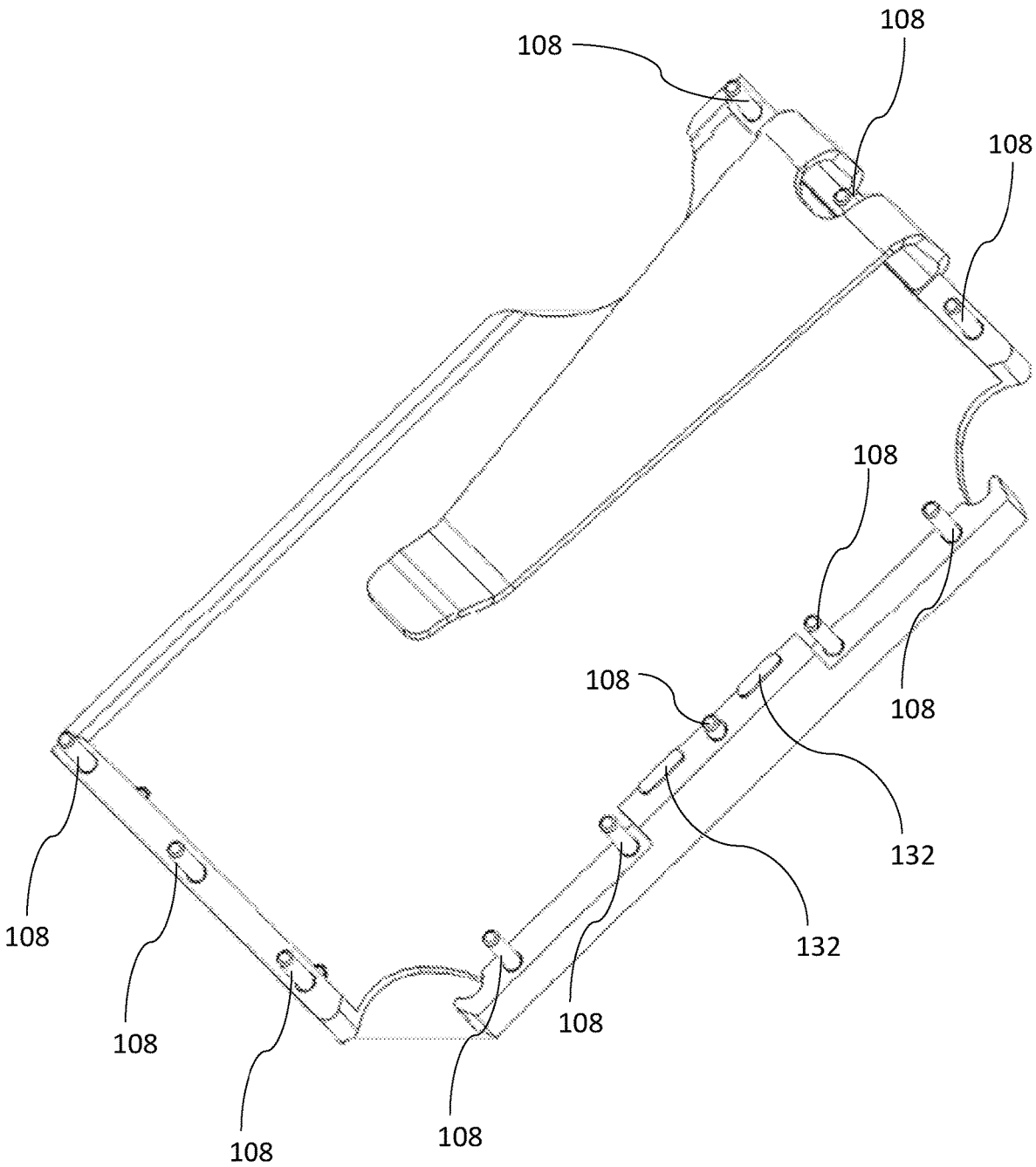
FIG. 12 is an interior view a front face plate of the wallet of FIG. 1.
Figure 13:
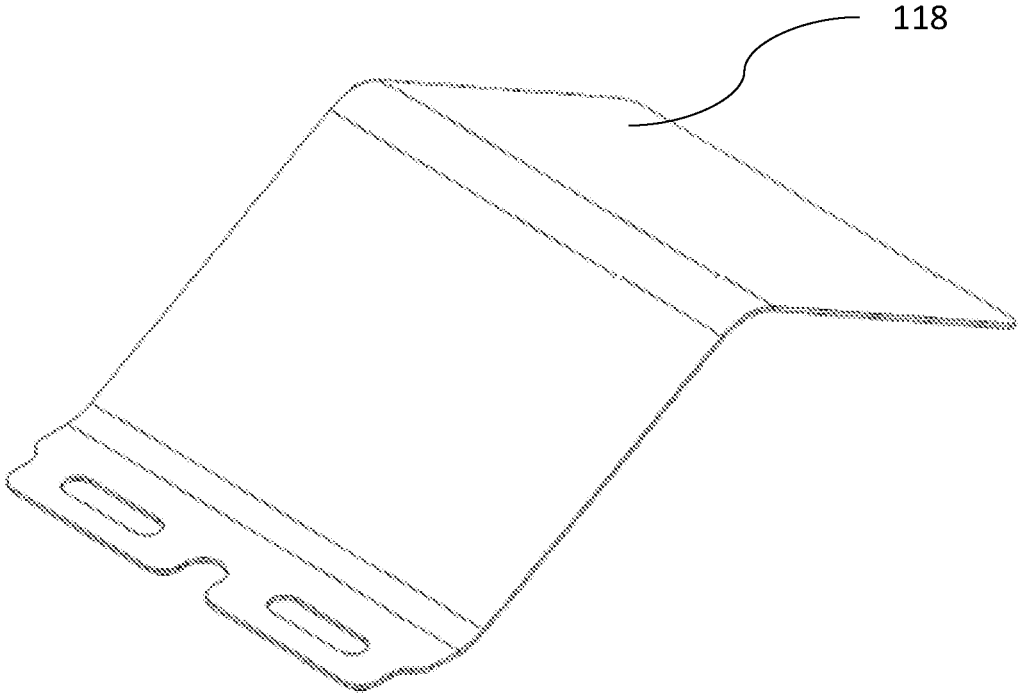
FIG. 13 is a perspective view of a spring plate for the wallet of FIG. 1.
Figure 14:
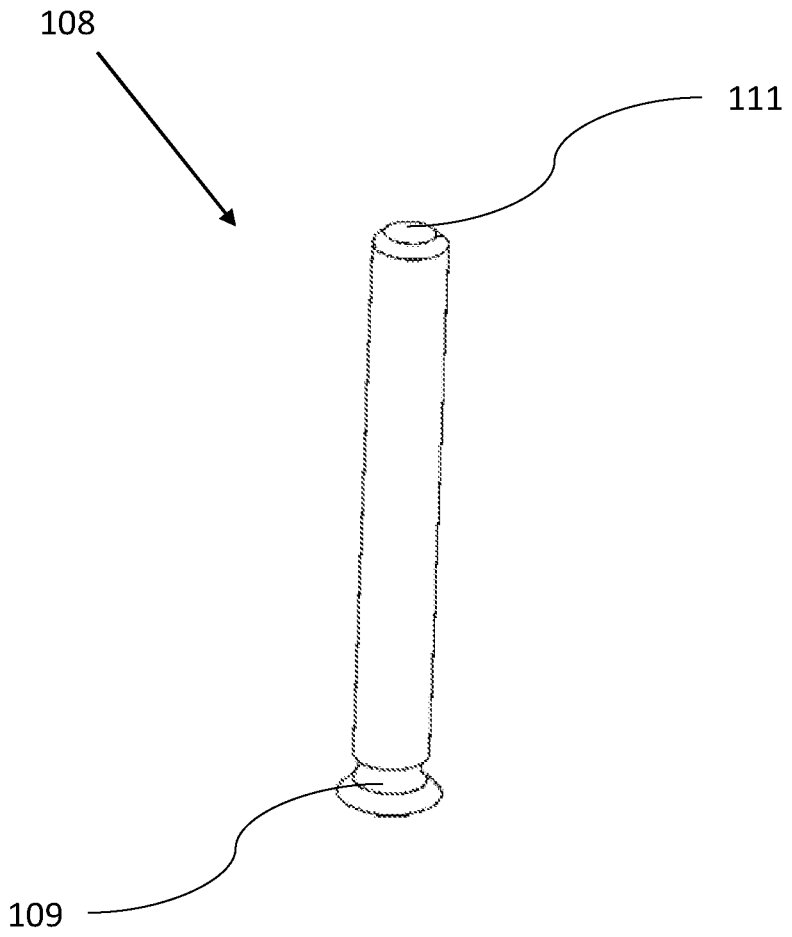
FIG. 14 is a view of a rivet for the wallet of FIG. 1.
Figure 15:
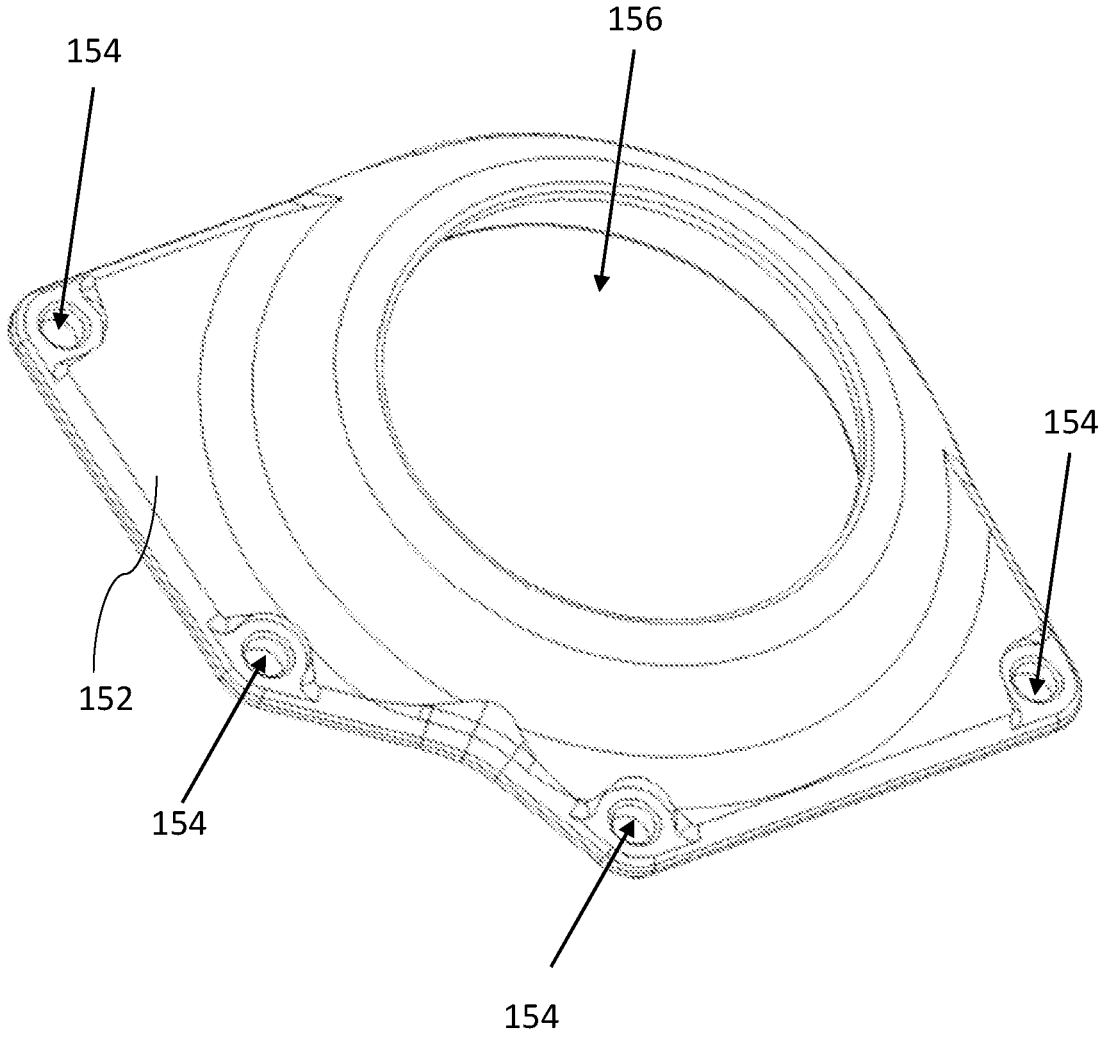
FIG. 15 is a front perspective view of an attachment device for the wallet of FIG. 1.
Figure 16:
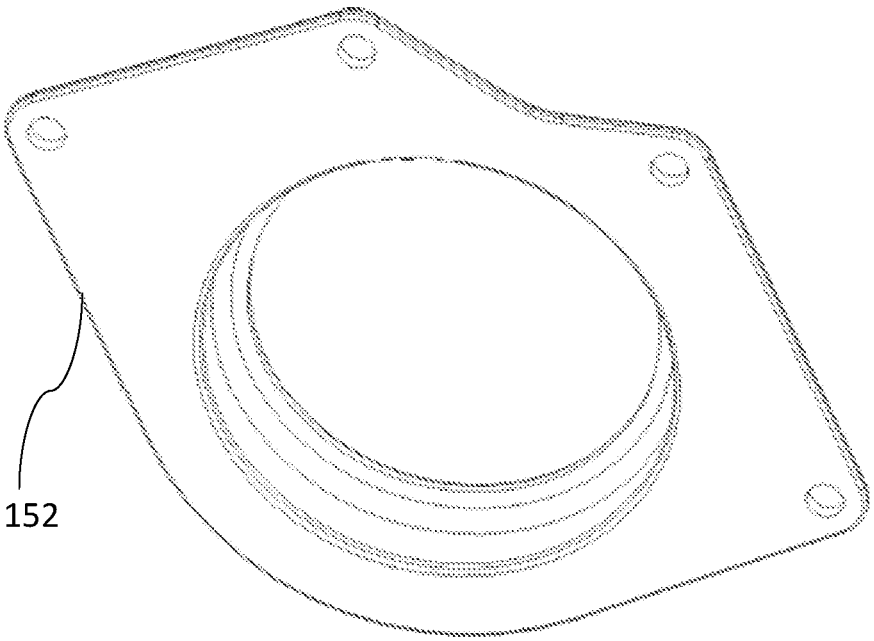
FIG. 16 is a rear perspective view of the attachment device of FIG. 15.

Referring now to FIGS. 1-22, a wallet in accordance with the subject technology is shown. In general, and as discussed more below, FIGS. 1-9 show a first embodiment of the wallet. FIGS. 10-12 show various aspects of the first embodiment, with certain components hidden or removed to better illustrate other components. FIGS. 13-17 show various isolated components of the wallet. FIGS. 18-22 show a second embodiment of the wallet, which includes an attached Apple AirTag. In general, the various embodiments and components shown herein can be assumed to be the same, and usable in conjunction with any of the embodiments and/or components herein, except as otherwise shown and described.

Referring now to FIGS. 1-22, a wallet 100 in accordance with the subject technology is shown. The body of the wallet 100 is formed by a front portion and a rear portion. The front portion includes a planar front face plate 102 and a planar rear face plate 104 which are fastened together in a parallel arrangement. The front face plate 102 and rear face plate 104 each include a number of aligned perforations 106 running around a perimeter. Rivets 108 (see FIG. 14) are sized and configured to extend between perforations and secure the front and rear portions of the body together. The rivets 108 are generally a metal, such as stainless steel or brass. The rivets 108 have one wider end 109 which cannot pass through the perforations 106 and acts as a stud, anchoring the rivet 108 to one of the face plates 102, 104. The opposite end 111 is narrower, and therefore after the rivets 108 are positioned within a first face plate 102, 104 with the wide end 109 acting as a stud, the opposing facing plate 102, 104 can be placed on top such that the narrower end 111 of each rivet 108 runs through a perforation 106 in that face plate 102, 104. The opposite end 111 of the rivets 108 are staked (pressed and deformed) into a v-shaped cavity in the perforations 106 of one of the face plates 102, 104 to secure the attachment between the plates 102, 104. In some instances, the rivets 108 can include prongs on their ends which can hold diamonds, or other stones, similar to the end of a ring, to add to the aesthetic qualities of the wallet 100. As discussed in more detail below, the rivets 108 also extend through an external clip 134 and spring plate 118 of the wallet 100, which secures all of the major components of the wallet 100 together.

Both the front and rear portions include a number of sidewalls 110*a-f* (generally 110) which extend perpendicularly from the front face plate 102 or the rear face plate 104, respectively, towards the opposite face plate 102, 104. The sidewalls 110 generally enclose the body of the wallet 100 on three sides, forming an interior cavity 112. A fourth side of the body is fully open, defining opening 114 between the face plates 102, 104 so that cards, or other objects, can be inserted into the cavity 112. The opening 114 allows for the easy removal of objects stored within the cavity 112. Each face plate 102, 104 can also include a crescent shaped cutout 116*a*, 116*b* on opposing sides of the cavity 112, which allows for objects, such as cards, stored within the cavity 112 to be more easily grasped by a user. Each face plate 102, 104 can be formed as a unitary body with respective sidewalls (110*a*-110*c* and 110*d*-110*f*, respectively), rather than as separate pieces, for improved durability and ease of manufacture. Generally the face plates 102, 104 and sidewalls 110 can be a rigid material, such as a solid metal. In addition to being durable, this provides an RFID barrier to prevent skimming of credit and debit cards, as well as security cards used for entrance into secured facilities. An RFID barrier generally prevents skimming of cards by absorbing, deflecting, or otherwise greatly reducing/limiting radio frequencies through the barrier. Aluminum has been found to be an effective metal for the plate faces 102, 104 and sidewalls 110. Other metals, include, but are not limited to stainless steel, gold, and titanium. It should be understood that other materials may also be used, such as other metals with RFID hindering capabilities.

In some instances, the sidewalls 110 can also not be a unitary body with the respective face plate 102, 104, but instead can be a separate attachable component (see, e.g., discussion of wallet 300 and FIGS. 23-35). The interchangeable sidewalls 110 can be easily swapped from different panels to allow a user to incorporate a different design aesthetic or utility use. For example, in some instances, the sidewalls 110 can be mounted to a respective face plate 102, 104. Sidewalls 110 can then be provided with different decorations. Some sidewalls 110 can also include various mounting mechanisms, allowing a user to mount accessories such as a mini flashlight, a laser, or other accessory.

As best seen in FIG. 11, a bendable spring plate 118 is contained within the cavity 112 of the body. The spring plate 118 can, for example, be a pliable material, such as a thin piece of metal or the like. In the example shown, the spring plate 118 forms an "V" shape between the front and rear face plates 102, 104, with ends 120*a*, 120*b* (generally 120) of the spring plate 118 being adjacent the rear face plate 104 and a middle bend 122 (or middle corner portion) adjacent the front face plate 102. This creates a sloped surface 124 facing the opening 114. Therefore, as a card is inserted through the opening 114 into the wallet 100, the insertion force against the sloped surface 124 causes the spring plate 118 to compress. After the card has been inserted, the middle bend 122 of the spring plate 118 contacts the card to apply a biasing force, pushing the card upwards and against the interior of the front face plate 102. This biasing force causes the card to generally remain secured within the cavity 112. However, the biasing force is easily overcome if an individual pulls the card directly towards the opening 114, thereby allowing for easy removal of cards from within the cavity 112. The crescent shaped cutouts 116 also allow the card to extend beyond the face plates 102, 104, allowing the user to view the card and easily grip the card for removal. Multiple additional cards can be added in this manner, and the retained within the cavity 112 by the spring plate 118.

The spring plate 118 sits within a recess 126 into the interior surface of the rear face plate 104. The recess 126 has a width that corresponds substantially to the width of the spring plate 118, and a length that corresponds to a length of the spring plate 118 when compressed (i.e., compressed such that the spring plate 118 extends to its maximum length). A first end 120*a* of the spring plate 118 is secured to the left sidewall of the body (110*a*, 110*d*). This can be done, as shown in the example provided, by including an end tab 128 on the spring plate 118 which includes two slots 130. The left sidewall 110*a* of the front face plate 102 includes two tabs 132 (as best seen in FIG. 12) which extend towards the rear face plate 104. The tabs 132 are sized and spaced to fit tightly within the two slots of the spring plate 118. When the front and rear face plates 102, 104 are secured together, the tabs 132 sit within the slots 130 and prevent the spring plate 118 from dislodging from the face plates 102, 104. Further, the tab 128 of the spring plate 118 can include a perforation 131 aligned with perforations 106 of the front face plate 102 and rear face plate 104. When the face plates 102, 104 are connected via the rivets 108, one rivet will extend through the perforation 131 of the spring plate 118 (while connecting perforations 106 of the front and rear face plates 102, 104) and will additionally help retain the spring plate 118 at the tabbed end (tab 128).

Figure 17:
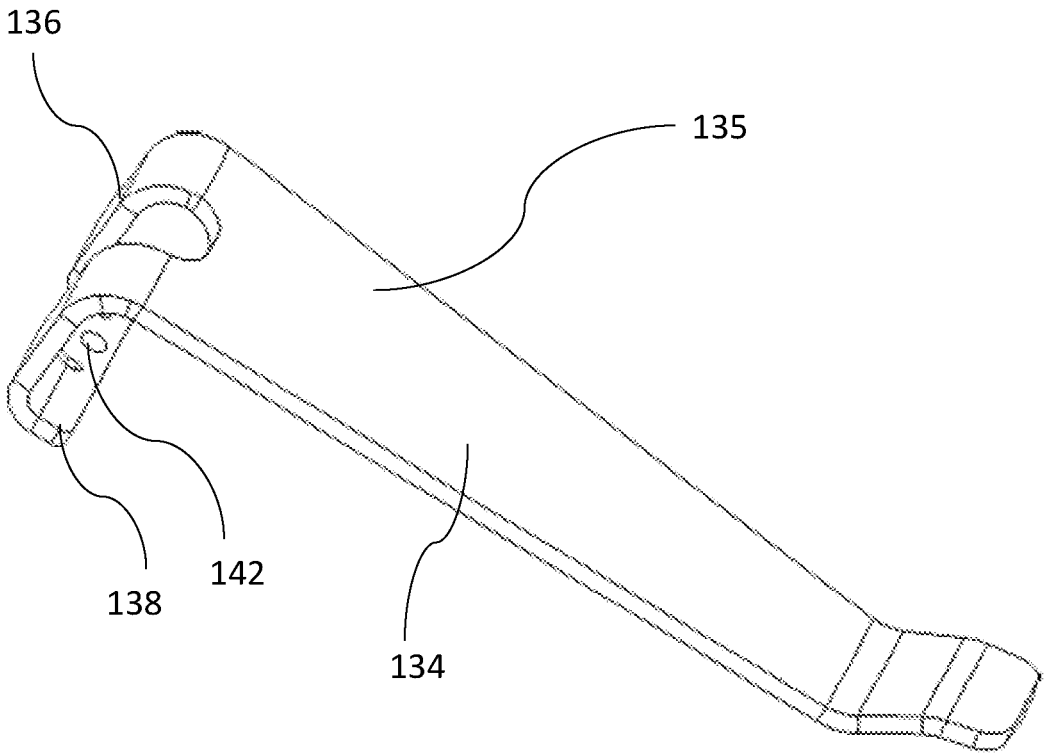
FIG. 17 is a perspective view of an external clip for the wall of FIG. 1.
Figure 18:
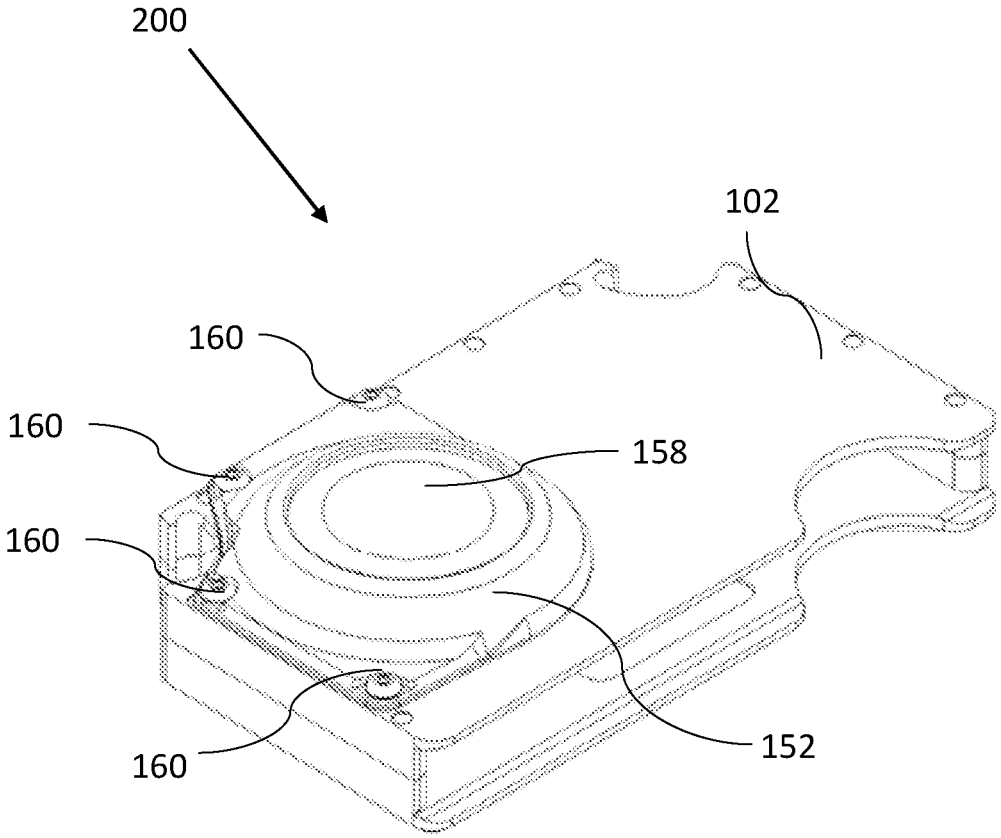
FIG. 18 is a front perspective view of another embodiment of a wallet.
Figure 19:
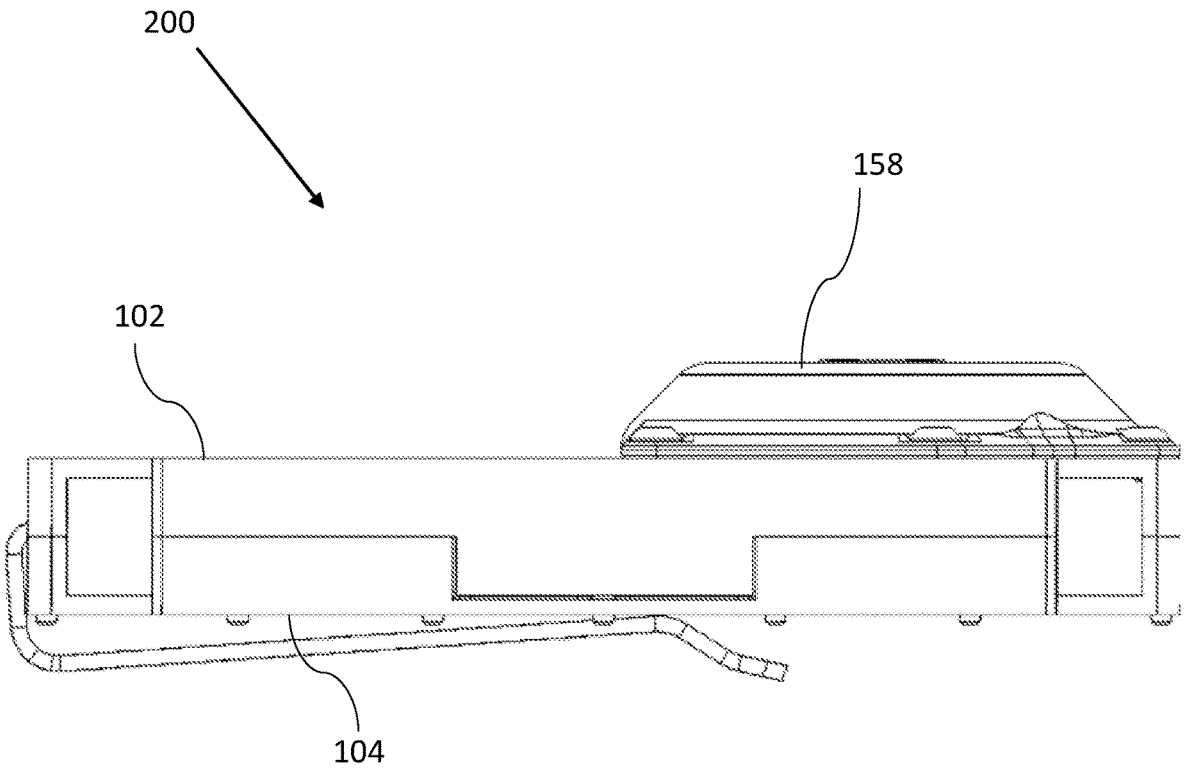
FIG. 19 is a left side view of the wallet of FIG. 18.
Figure 20:
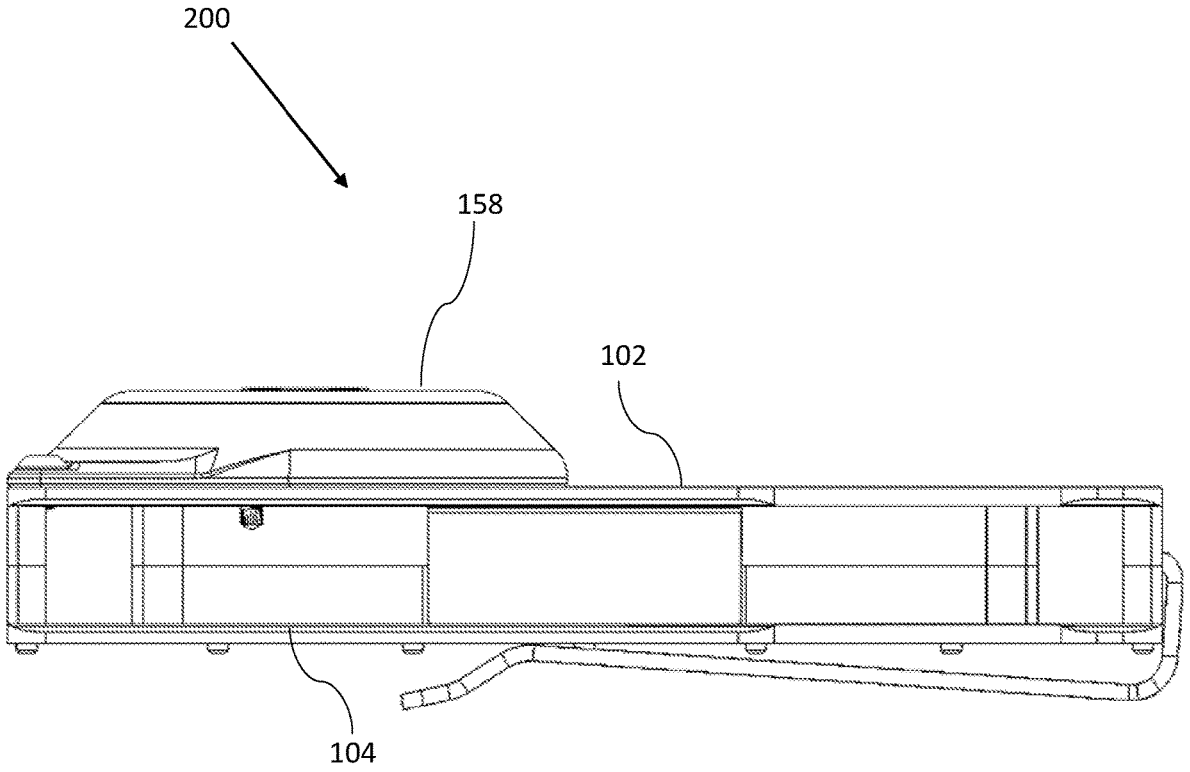
FIG. 20 is a right side view of the wallet of FIG. 18.
Figure 21:
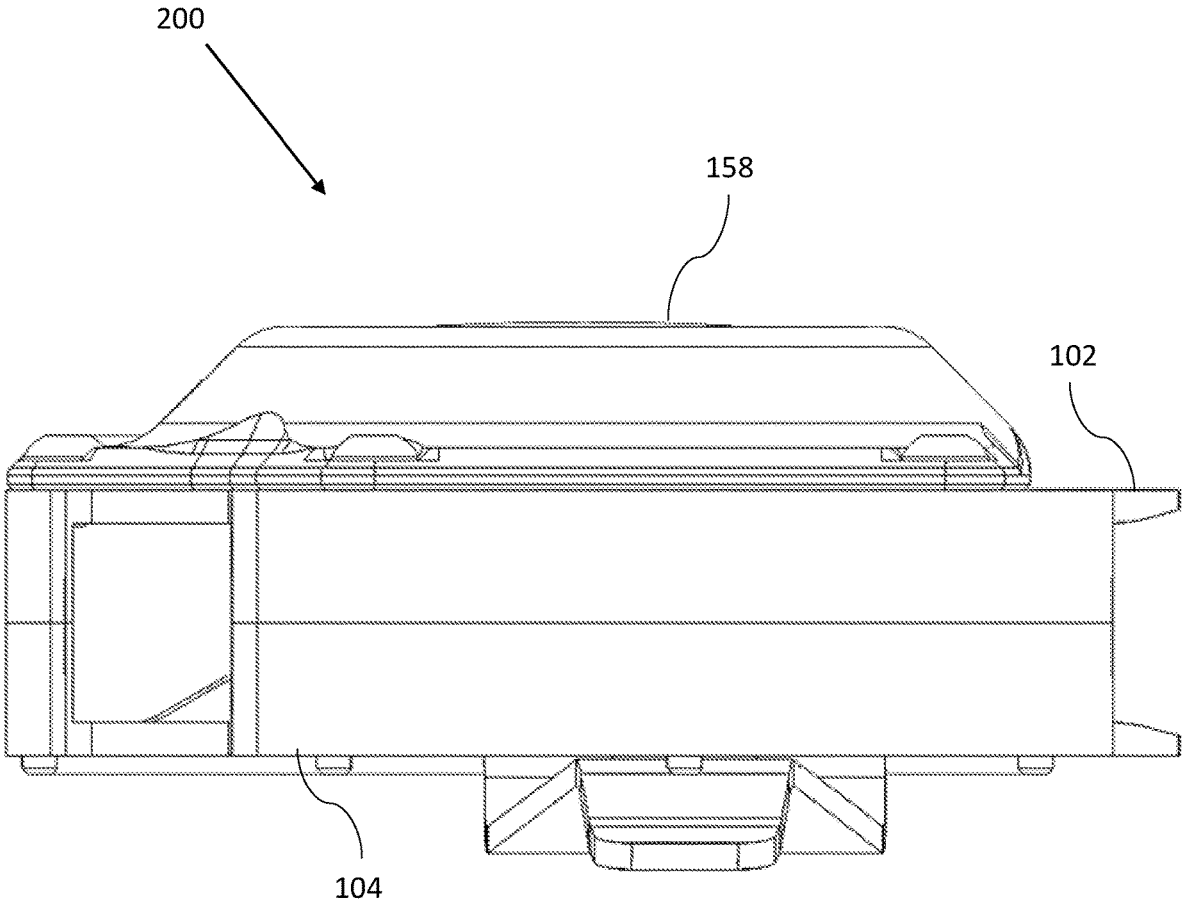
FIG. 21 is a bottom view of the wallet of FIG. 18.
Figure 22:
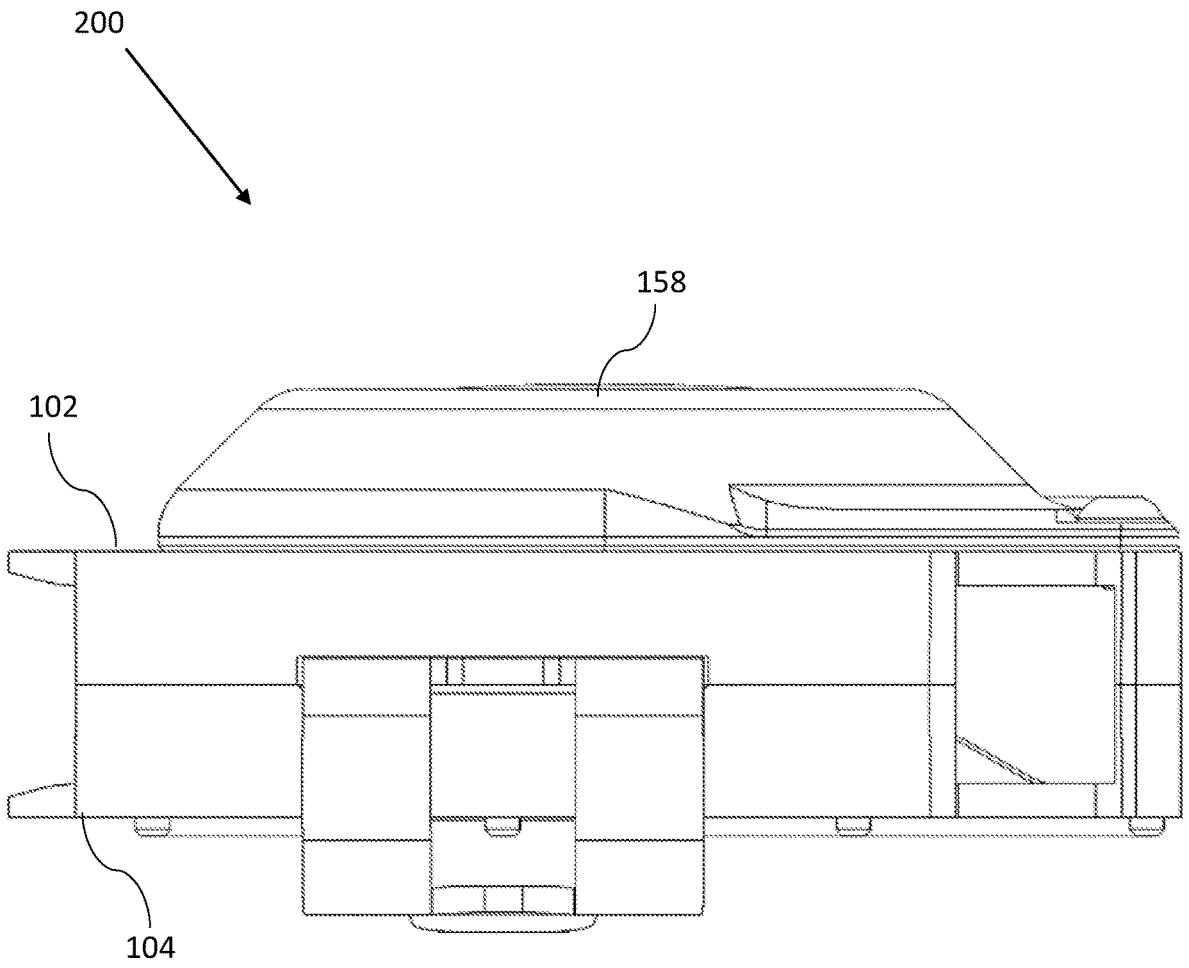
FIG. 22 is a bottom view of the wallet of FIG. 18.
Figure 23:
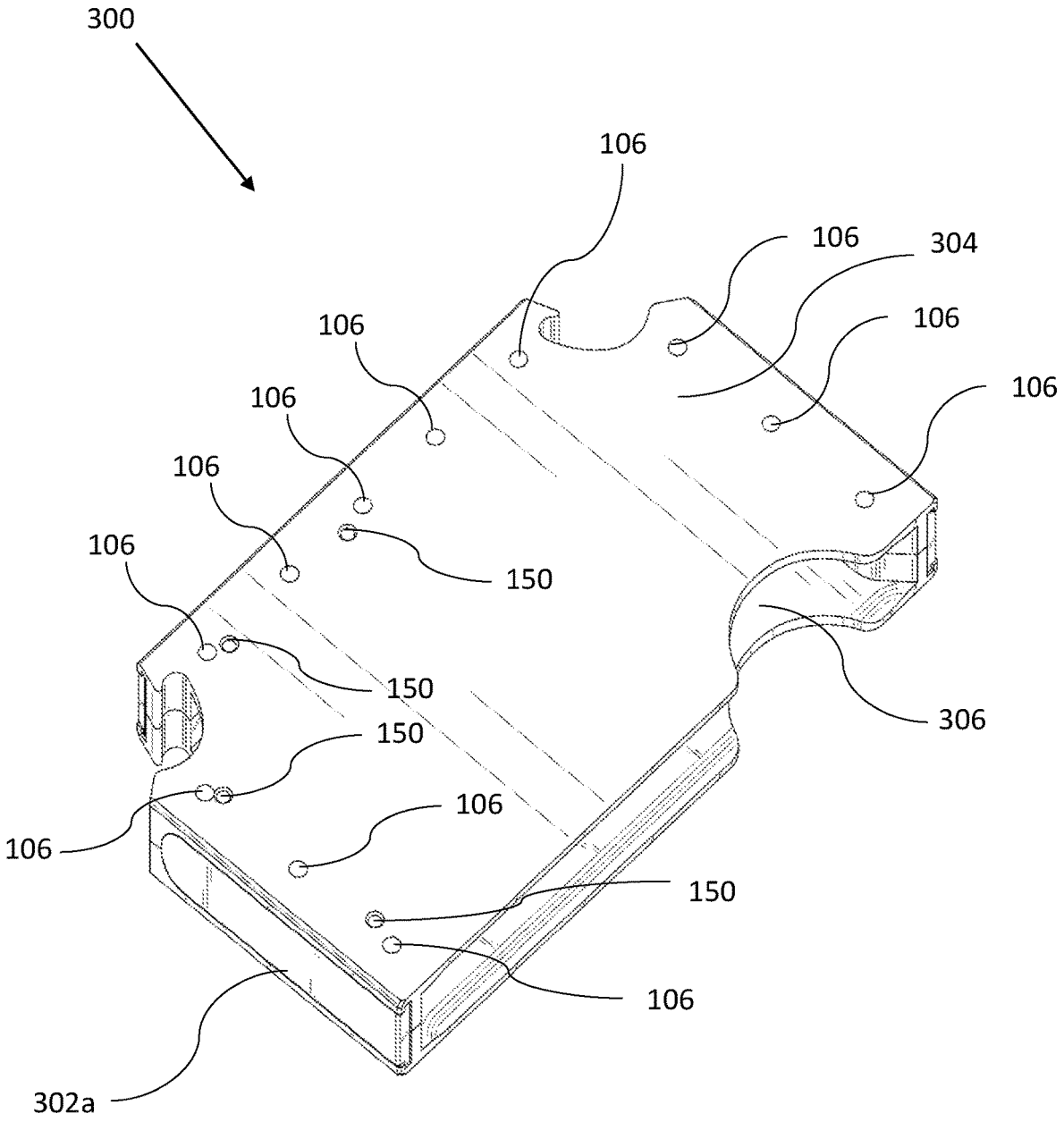
FIG. 23 is a front perspective view of another embodiment of a wallet.
Figure 24:
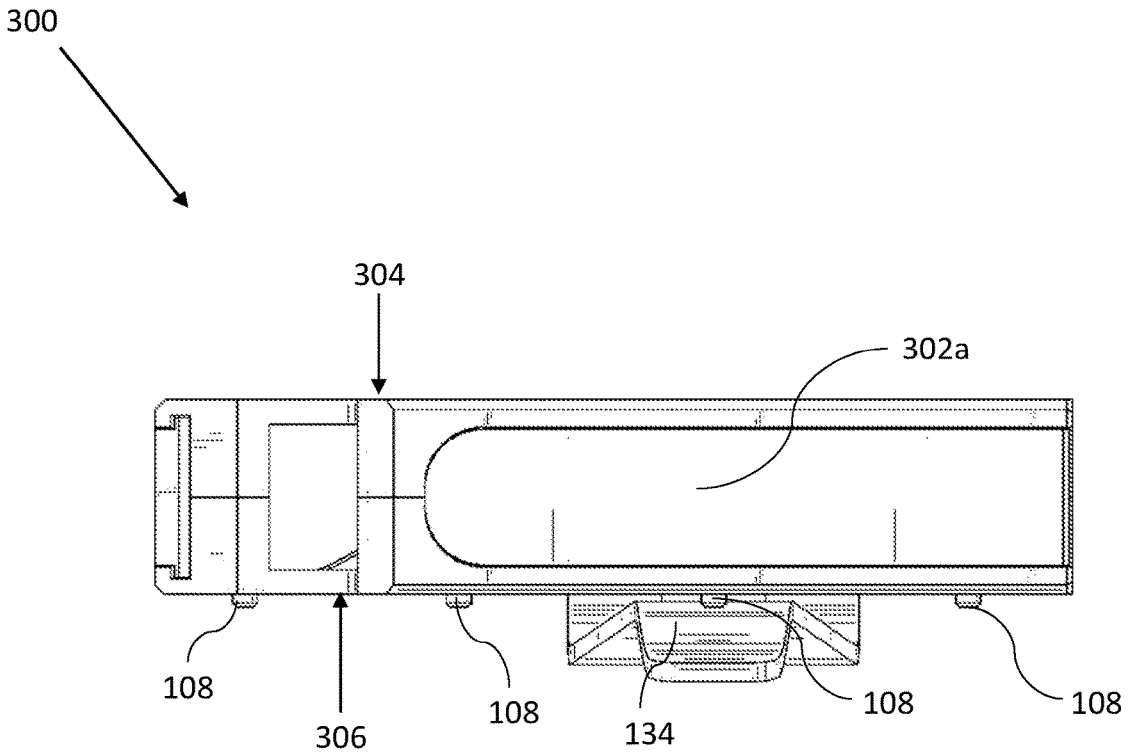
FIG. 24 is a bottom view of the wallet of FIG. 23.
Figure 25:
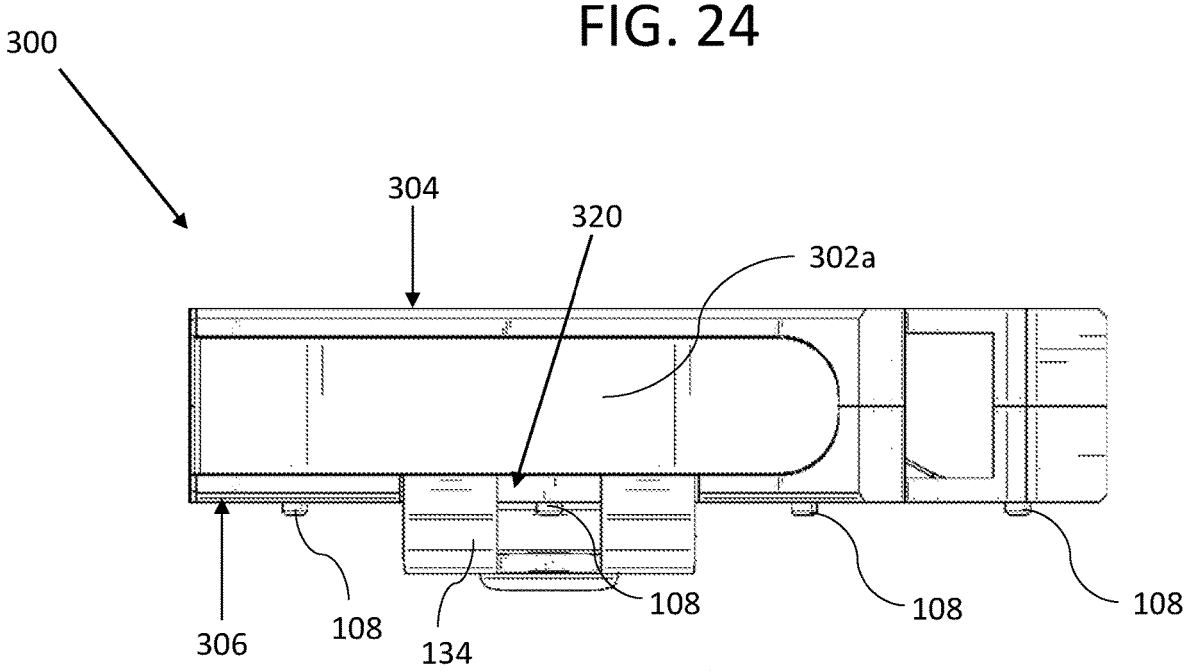
FIG. 25 is a top view of the wallet of FIG. 23.
Figure 26:
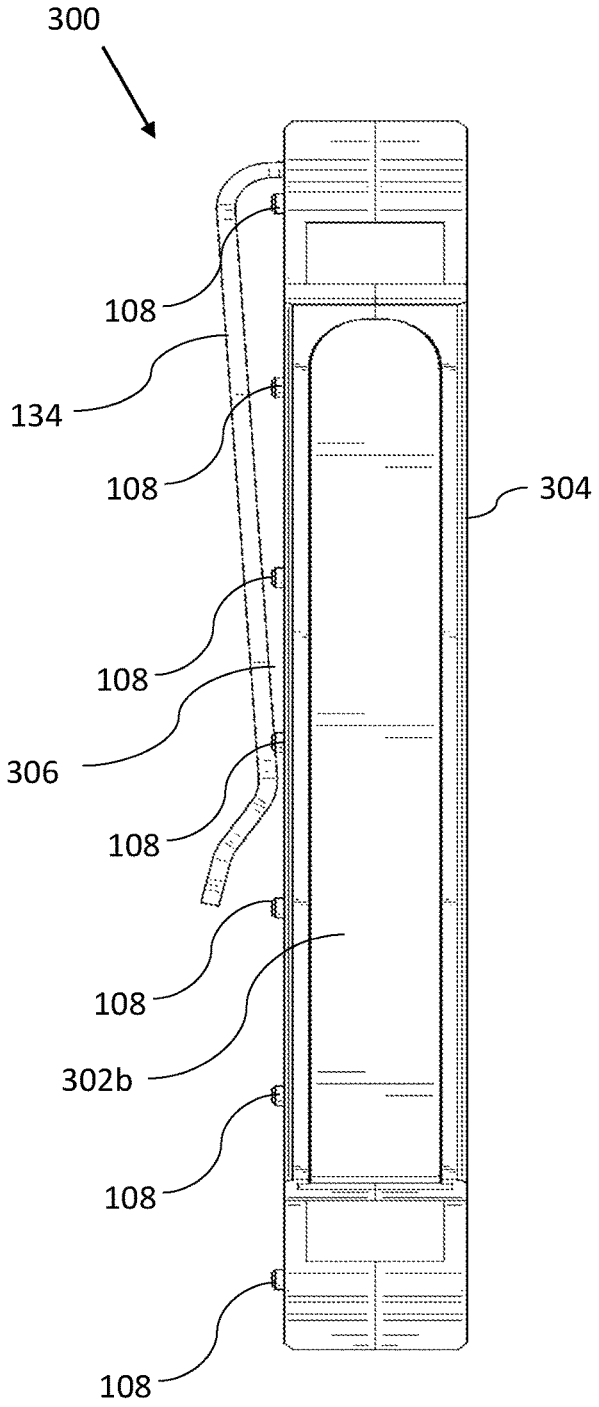
FIG. 26 is a left side view of the wallet of FIG. 23.
Figure 27:
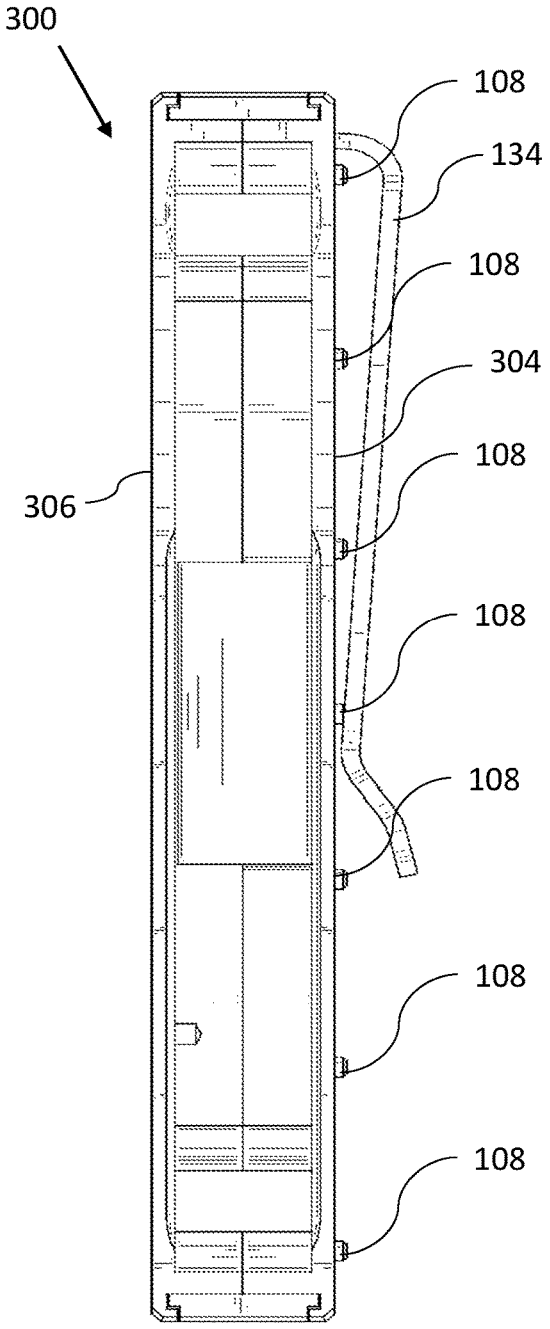
FIG. 27 is a right side view of the wallet of FIG. 23.
Figure 28:
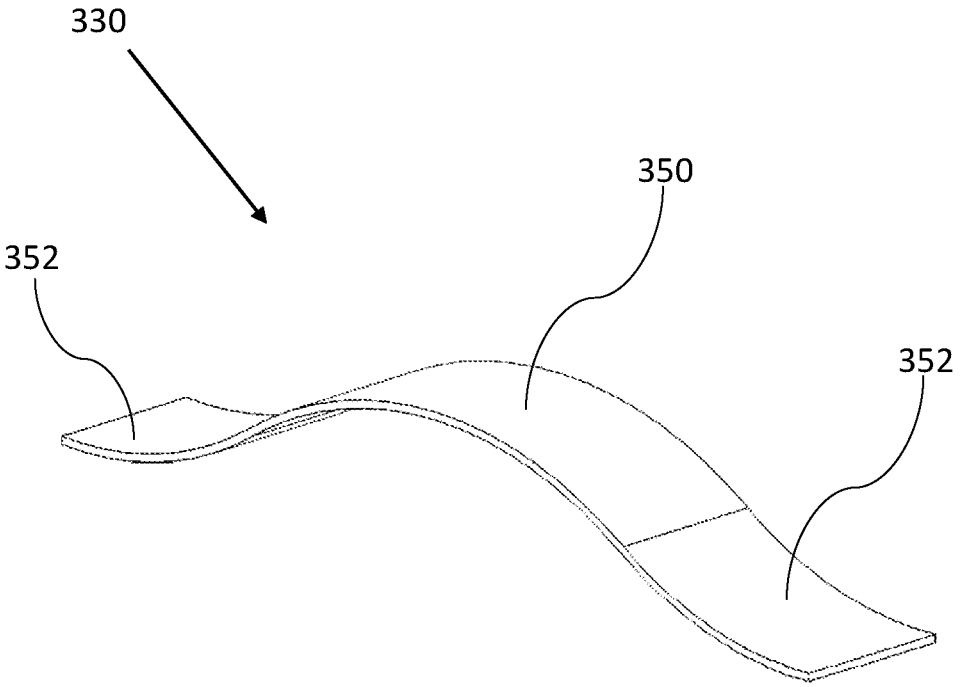
FIG. 28 is perspective view of a spring for the wallet of FIG. 23.

The wallet also includes an attachable external clip 134, which can be used to retain cash, cards, or the like. As best seen in FIG. 17, the clip 134 includes a curved end 136 which terminates in a lip 138. The upper sidewall (110*b*, 110*e*) of the body defines a corresponding slot 140 (for example, via a cutout in one of the sidewalls), which has a width slightly larger than the lip 138, allowing the lip 138 to pass through and into the cavity 112. The lip 138 also includes a central opening 142. When the front and rear face plates 102, 104 are fastened together the lip 138 will extend through the slot 140, and a rivet 108 and/or screw can pass through the opening 142 to secure the external clip 134 to the face plates 102, 104. This secures the external clip to the wallet (e.g., FIG. 1) unless the front and rear plates 102, 104 are decoupled. The clip 134 and an elongated support 135 that is positioned adjacent the length of the rear face plate 104 and is biased towards the rear face plate 104. This biasing force allows the clip 134 to removably retain cash, cards, or the like between the clip 134 and rear face plate 104.

The body of the wallet 100 can also be formed to provide various utility features. For example, as shown, corners connecting the closed sides of the body can include a cutout 144 and hooked end 146 which together act as a bottle opener. The cap of a bottle can be inserted within either cutout 144 with the hook 146 placed underneath the bottle cap. The bottle can then be leveraged against the side of the cutout opposite the hook 146 to remove the bottle cap.

The body of the wallet 100 can also include additional perforations 150 which allow for the attachment of additional of other objects. For example, as shown in FIG. 1, a number of perforations 150 are included. These perforations 150 are threaded for coupling to screws. The wallet 100 can also include an attachment device 152 (see FIGS. 15-16) with threaded perforations 154 in an analogous layout to the perforations 150 on the face plate 104, allowing the attachment device 152 to be attached to the front face plate 104 via screws. In the example shown, the attachment device 152 includes a central opening 156 configured to retain an Apple AirTag, allowing it to be easily coupled to, and carried with, the wallet. Other devices, such as a mini flashlight or laser could also be attached by similar means.

FIGS. 18-22 shown another embodiment of a wallet 200 in accordance with the subject technology. The wallet 200 is the same as the wallet 100 discussed herein, except as otherwise shown and described. In particular, the wallet 200 includes the attachment device 152 attaching an AirTag 158 (e.g., as made by Apple, Inc.) to a front face plate 102 of the wallet 200 via screws 160.

Referring now to FIGS. 23-35, another embodiment of a wallet 300 in accordance with the subject technology is shown. The wallet 300 is the same as the wallets 100, 200 discussed herein, except as otherwise shown and described. As will be discussed in more detail below, the wallet 300 includes removable side panels 302*a*, 302*b* (collectively 302). The side panels 302 provide a mechanism for sealing the wallet 300 on three sides, leaving only one open side for the insertion of cards or the like. The side panels 302 can easily be removed or swapped to change the aesthetics of the wallet 300. The side panels 302 also provide a mechanism that allows for the attachment of functional components. For example, functional components such as a mini flashlight or laser could also be attached by a side panel 302 that included such components, or include any known mechanical attachment mechanism for attaching such components.

Similar to the wallet 100, the wallet 300 includes a front face plate 304 and a rear face plate 306 which include perforations 106 around their perimeter. The perforations are configured to engage with rivets 108 to attach the front face plate 304 to the rear face plate 306 to form the body of the wallet 300. Also similarly, additional perforations 150 can be included to attach other devices, such as an AirTag, to one or more of the face plates 304, 306.

As best seen in FIGS. 32-35, along the sides where the face plates 304, 306 meet, side recesses 310*a*, 310*b*, 310*c* (generally 310) are formed. In the example shown, recess 310*a* is formed on the top of the wallet 300 between face plates 304, 306, recess 310*b* is formed on the left side of the wallet 300 between face plates 304, 306, and recess 310*c* is formed on the bottom of the wallet 300 between face plates 304, 306. Each side panel 302 is designed to removably slide into one of the recesses 310 to be contained within that recess 310 when in use. Each side panel 302 is sized generally to have a slightly smaller perimeter than the corresponding recess 310, such that the side panel 302 can rest comfortably within the recess 310. The face plates 304, 306 also include tabs 312 (see FIGS. 32-35), or overhangs, extending over the sides of the wallet 300 around the perimeter of each recess 310 on three sides (note, the top tab 312 includes a cutout 320 for clip 134). The tabs 312 are sized to provide a retention area that is narrower than the perimeter of the corresponding side panel 302 to prevent the side panel 302 from being removed outwardly from the wallet 300. While the tabs 312 form a perimeter on three sides of the recess 310, a fourth side defines an opening channel 314 through which one of the side panels can be inserted into the recess 310.

Figure 29:
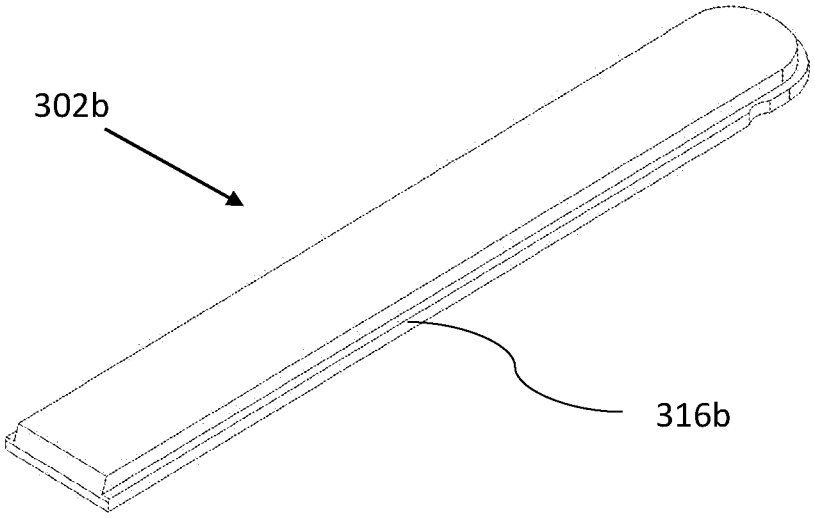
FIG. 29 is a front perspective view of a side panel for the wallet of FIG. 23.
Figure 30:
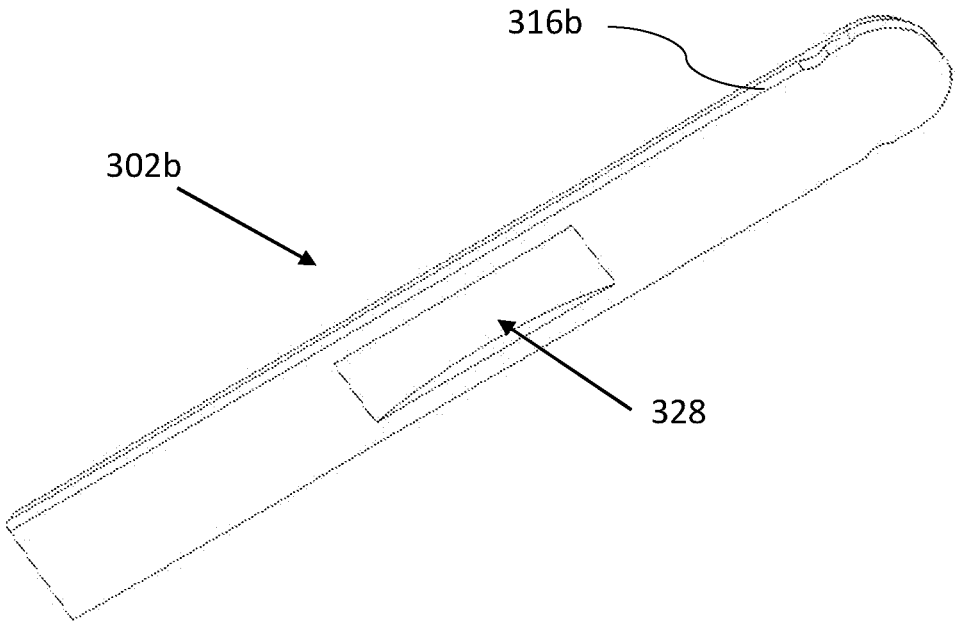
FIG. 30 is a rear perspective view of the side panel of FIG. 29.
Figure 31:
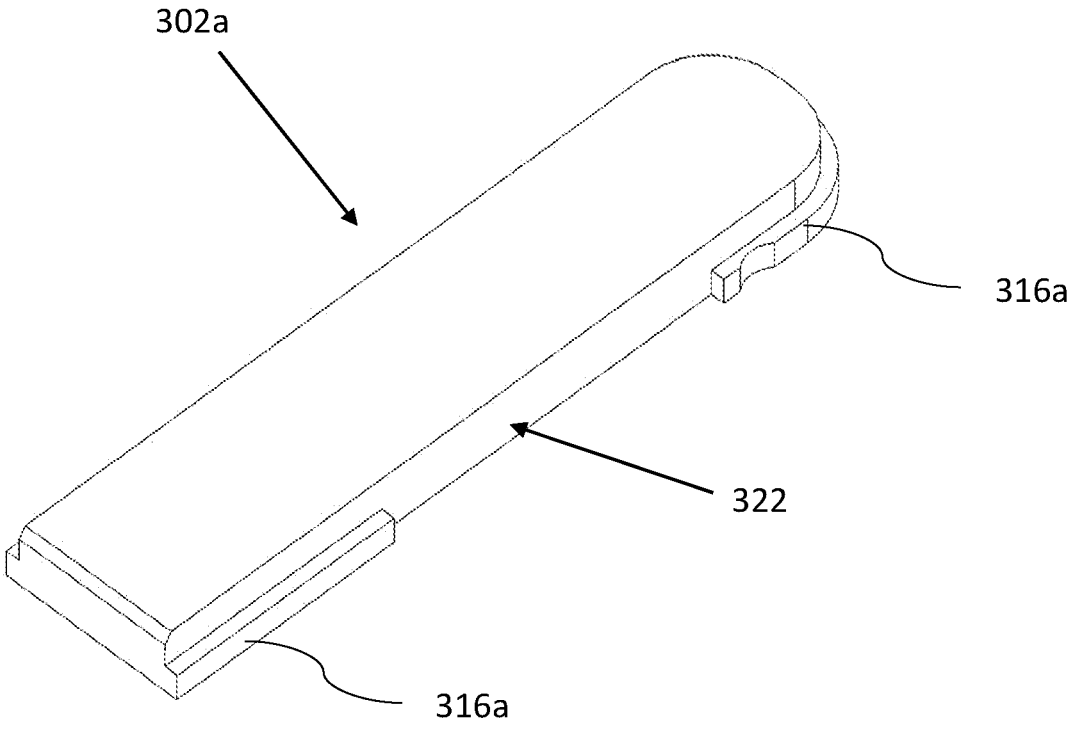
FIG. 31 is a front perspective view of another side panel for the wallet of FIG. 23.

FIGS. 29-31 show isolated views of side panels 302 which can be used in accordance with the recesses shown herein. In general, side panel 302*b* is a longer panel which is designed to run along the length of the wallet 300 (e.g., on the left side, as shown herein), while panel 302*a* is a shorter panel designed to run along the width of the wallet (e.g., on the top and bottom sides, as shown herein).

The side panels 302 each include stepped ridges 316*a*, 316*b* (generally 316) which engage with the tabs 312 of the face plates 304, 306, providing a tight fit. As such, the stepped shape of the ridges 316 corresponds to the shape of the tabs 312 to create contact when in use. Likewise, the ridges 316 extend around the perimeter of the side panels 302 substantially on three sides, corresponding to the three sides of the tabs 312 (with no the side panel 302 having no ridge 316 on the side of the perimeter adjacent the opening 314). The side panel 302*a* can include a cutout 322 area with no ridge in the area adjacent to the cutout 320 of the top tab 312. The front surface 324 of the panels 302 will be outwardly facing when in use, and therefore can include a design and/or a functional attachment. The rear surface of the panels 302 includes a concave recess 328 (see FIG. 30) which engages a spring mechanism 330 (e.g., a spring or spring plate, see FIG. 28) to hold the panel 302 in place while in use. The spring mechanism 330 is generally a sheet of thin, flexible material, such as metal, which is flexible across its length. The spring mechanism 330 forms a generally convex shape with an arcuate center portion 350 between opposing flat ends 352.

Figure 32:
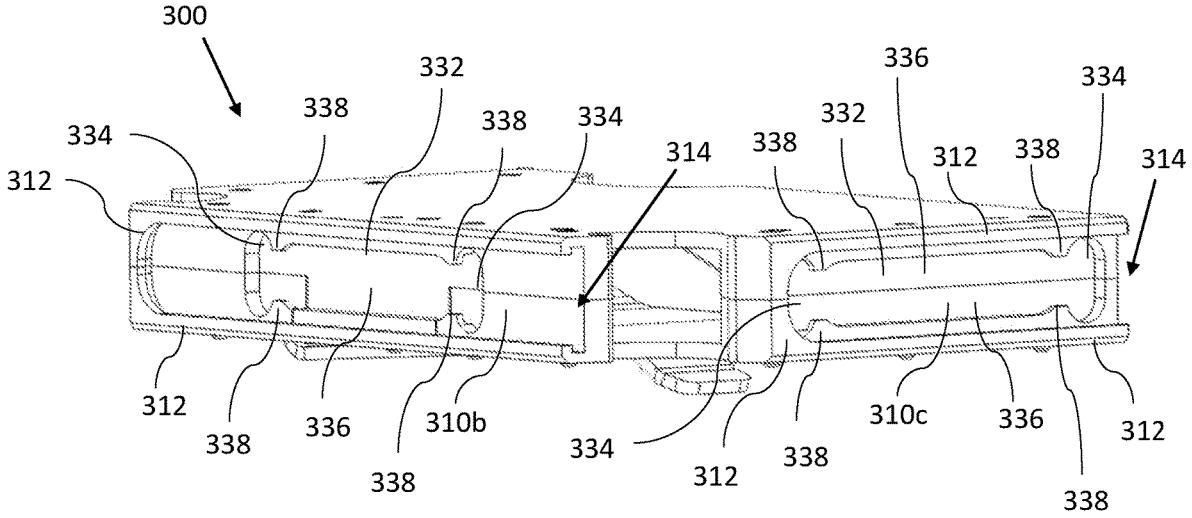
FIG. 32 is a left-bottom perspective view of the wallet of FIG. 23, with certain features not shown.
Figure 33:
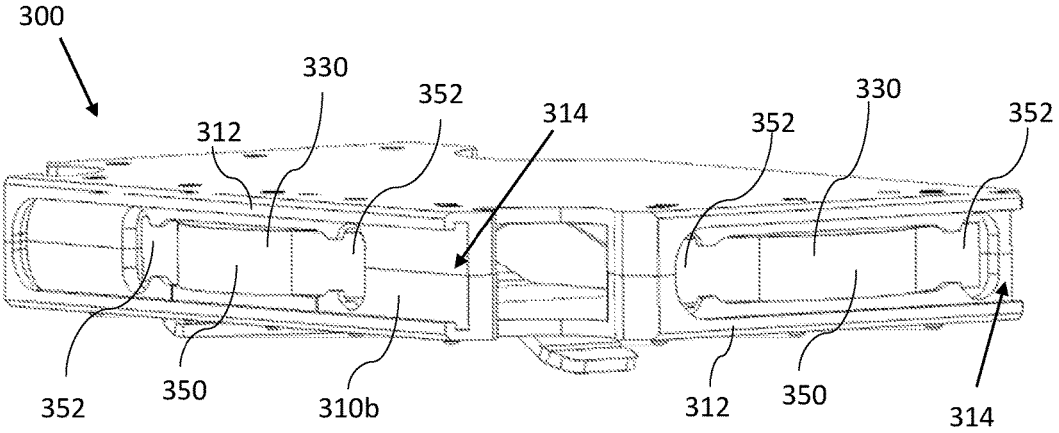
FIG. 33 is another left-bottom perspective view of the wallet of FIG. 23, with certain features not shown.
Figure 34:
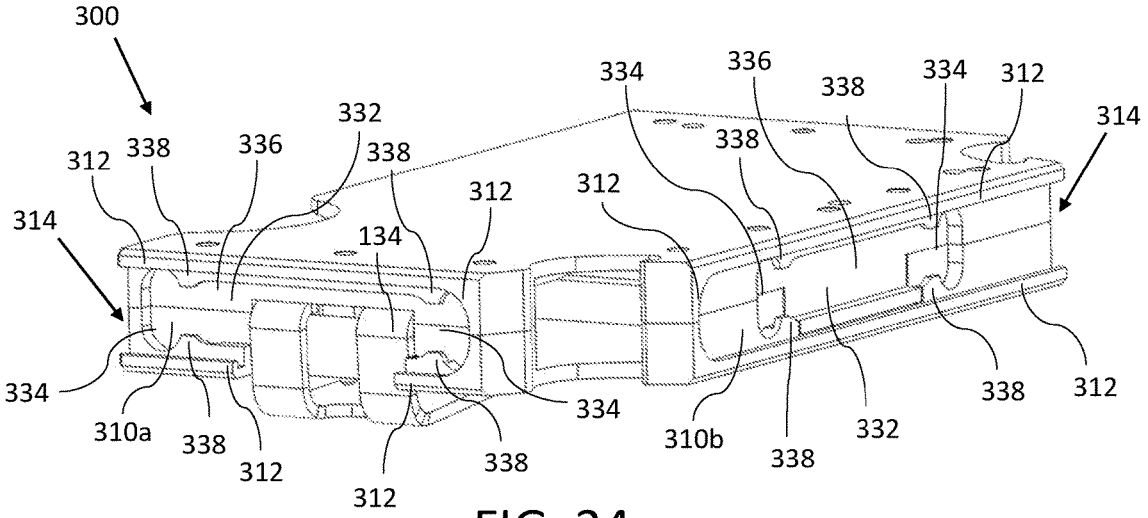
FIG. 34 is a top-left perspective view of the wallet of FIG. 23, with certain features not shown.

Referring now to FIGS. 32-35, each recess 310 includes a second, embedded recess 332 which is designed to engage a spring mechanism 330. FIGS. 32 and 34 show the embedded recesses without a spring mechanism 330, while FIGS. 33 and 35 mirror those respective figures after a spring mechanism 330 has been attached within a corresponding embedded recess 332. Each embedded recess 332 has two opposing ends 334 and an elongated middle section 336 which are wider than the spring mechanism 330. On each side, the ends 334 are separated from the middle section 336 by a neck 338 which creates a narrower width than the spring mechanism 330. The spring mechanism 330 can be installed in an embedded recess 332 prior to connecting the face plates 304, 306 with rivets 108. In the alternative, the spring mechanism 330 could be compressed and inserted into the middle section 336 of the recess 332 before being allowed to expand, such that ends 352 of the spring mechanism 330 are slotted under the neck 338 while extending into the ends 334 of the embedded recess 332. In this orientation, the necks 338 essentially create retention tabs on the exterior of the spring mechanism 330, removably holding the spring mechanism 330 within the embedded recess 332.

Figure 35:
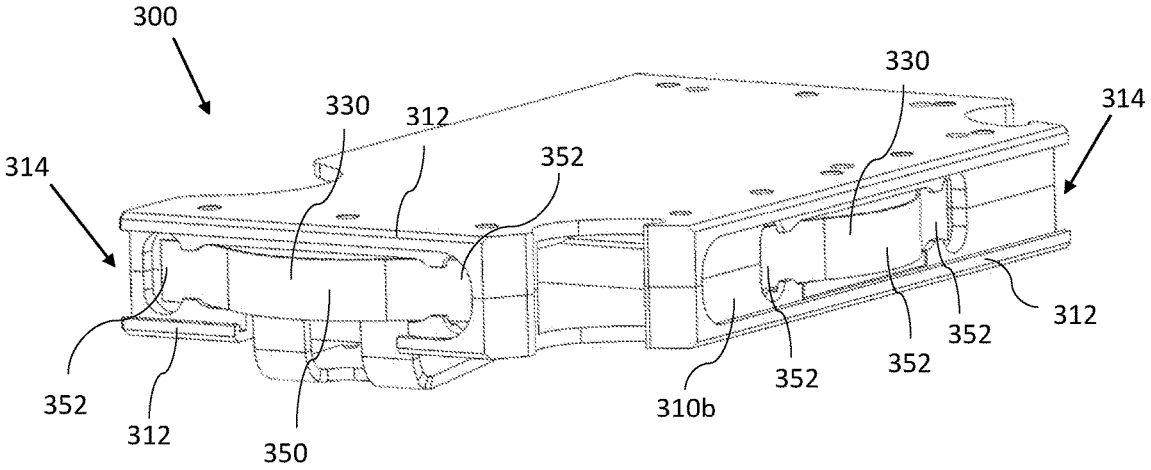
FIG. 35 is another top-left perspective view of the wallet of FIG. 23, with certain features not shown.

As shown in FIGS. 33 and 35, each spring mechanism 330, once seated within an embedded recess 332, extends, in a convex shape (i.e., center portion 350) outwardly through the corresponding initial recess 310. The convex center portion 350 of the spring mechanism 330 is designed to couple to the concave recess 328 of a side panel 302. Therefore, as each side panel 302 slides into a recess 310 of the wallet 300, the side panel 302 will initially compress the spring mechanism 330 until the concave recess 328 of the side panel 302 is positioned adjacent to the center portion 350 of the spring mechanism 330. The center portion 350 of the spring mechanism 330 will then extend into the concave recess 328 to prevent movement of side panel 302 within the recess 310. The spring mechanism 330 may also apply some biasing force to force the side panel against the tabs 312. However, with the application of an inward pressure on the side panels 302, the biasing force can be overcome and the spring mechanism 330 can be compressed, such that the side panel 302 can be removed through the corresponding opening 314. As such, this provides a mechanism for removably attaching side panels 302. This allows the side panels 302 to be quickly swapped out when a user desires to change designs or swap functional components connected to the side panels 302.

All orientations and arrangements of the components shown herein are used by way of example only. Further, it will be appreciated by those of ordinary skill in the pertinent art that the functions of several elements may, in alternative embodiments, be carried out by fewer elements or a single element. Similarly, in some embodiments, any functional element may perform fewer, or different, operations than those described with respect to the illustrated embodiment. Also, functional elements shown as distinct for purposes of illustration may be incorporated within other functional elements in a particular implementation.

While the subject technology has been described with respect to preferred embodiments, those skilled in the art will readily appreciate that various changes and/or modifications can be made to the subject technology without departing from the spirit or scope of the subject technology. For example, each claim may depend from any or all claims in a multiple dependent manner even though such has not been originally claimed.

What is claimed is:

1. A wallet comprising:

a metal body formed from a front face plate connected to a rear face plate and forming a cavity therebetween, the front face plate and rear face plate defining sidewalls on three separate sides of the body and an opening on a fourth side of the body, wherein the front face plate and rear face plate include aligned perforations extending around their perimeter;

a plurality of rivets extending between aligned perforations in the front face plate and the rear face plate, the rivets including: a first stud end anchored to the rear face plate; and a second end staked within one of the perforations of the front face plate;

a recess formed in one of the sidewalls, wherein tabs of the body overhang a perimeter of the recess on three sides of the recess, and with a fourth side of the recess being open;

an embedded recess within the recess, the embedded recess configured to retain a spring such that a convex portion of the spring extends outward from the embedded recess; and a removable side panel configured to be slidably retained within the recess, wherein: when the removable side panel is positioned within the recess, the spring engages the removable side panel to secure the removable side panel between the spring and the tabs; and applying a force to an exterior of the removable side panel depresses the spring, allowing the side panel to be removed.

2. A wallet comprising:

a metal body formed from a front face plate connected to a rear face plate and forming a cavity therebetween, the front face plate and rear face plate defining sidewalls on three separate sides of the body and an opening on a fourth side of the body, a recess defined within an interior surface of the rear face plate, wherein the front face plate and rear face plate include aligned perforations extending around their perimeter;

a plurality of rivets extending between aligned perforations in the front face plate and the rear face plate, the rivets including: a first stud end anchored to the rear face plate; and a second end staked within a perforation of the front face plate;

an external clip comprising a curved end secured to the body by one of the rivets and an elongated support positioned adjacent, and biased towards, the rear face plate; and a spring plate within the cavity and recess, configured to flex towards the rear face plate in response to force, and provide a biasing force towards the front face plate, wherein the spring plate includes a first end and a second end each positioned within the recess and adjacent the rear face plate;

wherein:

the first end of the spring plate is coupled to the rear face plate and the second end of the spring plate is free to move with respect to the rear face plate;

the spring plate defines a sloped surface facing the opening;

the spring plate is configured to flex and compress, in response to force applied to the sloped surface; and while in a compressed state, the spring plate provides a biasing force against objects within the cavity to force said objects against the front face plate and retain said objects within the cavity;

wherein the spring plate includes two slots proximate the first end and the front face plate includes two tabs extending into the cavity, the two tabs being sized and shaped to fit within the slots of the spring plate; and wherein the two tabs of the front face plate engage the slots to retain the spring the first end of the spring plate.

3. The wallet of claim 2, wherein the front face plate and the rear face plate each include a crescent shaped cutout proximate the opening.

4. The wallet of claim 2, wherein the spring plate includes a perforation through the first end, the perforation of the spring plate being aligned with a perforation of the front face plate and a perforation of the rear face plate, such that a rivet runs through said perforations of the spring plate, front face plate, and rear face plate to retain the spring plate.

5. A wallet comprising:

a metal body formed from a front face plate connected to a rear face plate and forming a cavity therebetween, the front face plate and rear face plate defining sidewalls on three separate sides of the body and an opening on a fourth side of the body;

a recess formed in one of the sidewalls, wherein tabs of the body overhang a perimeter of the recess on three sides of the recess, and with a fourth side of the recess being open;

an embedded recess within the recess, the embedded recess configured to retain a spring such that a convex portion of the spring extends outward from the embedded recess; and a removable side panel configured to be slidably retained within the recess, wherein: when the removable side panel is positioned within the recess, the spring engages the removable side panel to secure the removable side panel between the spring and the tabs; and applying a force to an exterior of the removable side panel depresses the spring, allowing the side panel to be removed.

6. The wallet of claim 5, wherein:

the removable side panel includes a panel recess on a side adjacent the spring, the panel recess being a concave shape corresponding to the convex shape of the spring; and the spring engages the removable side panel by extending into the panel recess.

7. The wallet of claim 5, wherein each sidewall of the wallet includes:

a recess with tabs of the body overhanging a perimeter of the recess on three sides of the recess, and with a fourth side of the recess being open;

an embedded recess within the recess configured to retain a spring such that a convex portion of the spring extends outward from the embedded recess; and a removable side panel configured to be slidably retained within the recess, wherein: when each removable side panel is positioned within the respective recess, the respective spring engages said removable side panel to secure said removable side panel between said spring and the tabs of the respective recess; and applying a force to an exterior of each removable side panel depresses the respective spring, allowing said removable side panel to be removed.

8. The wallet of claim 7, wherein each removable side panel includes a stepped ridge, wherein the stepped ridges are configured to engage the tabs.

9. The wallet of claim 5, wherein the spring is a thin, flexible sheet of metal.

10. The wallet of claim 5, wherein:

the embedded recess includes a first end, a second end, and a middle section;

a first neck forms a narrow area between the first end and the middle section of the embedded recess;

a second neck forms a narrow area between the middle section and the second end of the embedded recess; and the first neck and the second neck retain opposing ends of the spring, holding the spring within the embedded recess.

* * * * *